US011834300B2

(12) United States Patent
Duvall et al.

(10) Patent No.: US 11,834,300 B2
(45) Date of Patent: Dec. 5, 2023

(54) STABILIZING ASSEMBLIES AND METHODS OF USE THEREOF

(71) Applicant: TK Elevator Innovation and Operations GmbH, Duesseldorf (DE)

(72) Inventors: Jeffrey Shawn Duvall, Smyrna, GA (US); Erin Nicole Seligsohn, Smyrna, GA (US)

(73) Assignee: TK Elevator Innovation and Operations GmbH, Duesseldorf (DE)

( * ) Notice: Subject to any disclaimer, the term of this patent is extended or adjusted under 35 U.S.C. 154(b) by 0 days.

(21) Appl. No.: 17/398,659

(22) Filed: Aug. 10, 2021

(65) Prior Publication Data

US 2023/0047079 A1 Feb. 16, 2023

(51) Int. Cl.
*B66B 7/04* (2006.01)
*B66B 11/02* (2006.01)

(52) U.S. Cl.
CPC ..... *B66B 7/042* (2013.01); *B66B 7/046* (2013.01); *B66B 11/0286* (2013.01)

(58) Field of Classification Search
CPC ..... B66B 7/042; B66B 7/046; B66B 11/0286
See application file for complete search history.

(56) References Cited

U.S. PATENT DOCUMENTS 5,086,882 A * 2/1992 Sugahara ..... B66B 7/046 187/410
5,117,946 A * 6/1992 Traktovenko ..... B66B 7/046 187/410
6,474,449 B1 * 11/2002 Utsunomiya ..... B66B 7/042 187/292
9,321,610 B2 * 4/2016 Fargo ..... B66B 7/041
9,643,820 B2 * 5/2017 Arai ..... B66B 17/34
9,975,733 B2 * 5/2018 Cunningham ..... B66B 5/18
10,662,031 B2 * 5/2020 Villa ..... B66B 7/042
10,737,907 B2 * 8/2020 Guo ..... B66B 11/0293
11,142,431 B2 * 10/2021 Li ..... B66B 5/18
2009/0032340 A1 * 2/2009 Smith ..... B66B 7/042 188/73.31

(Continued)

FOREIGN PATENT DOCUMENTS

CA 2312595 C 12/2007
CN 102239102 B 1/2016

(Continued)

*Primary Examiner* — Michael A Riegelman
(74) *Attorney, Agent, or Firm* — Dinsmore & Shohl LLP

(57) ABSTRACT

Embodiments here are directed to an elevator stabilizing assembly for energy dissipation of an elevator assembly is provided. The elevator stabilizing assembly includes an actuator and a stabilizing device. The actuator is configured to move between a retracted position and an extended position. The stabilizing device includes an arm and a biasing member. The biasing member is coupled to the arm and biases the arm to move the arm between a disengaged position and an engaged position. When the actuator is in the extended position, the arm is moved into the engaged position when at least a portion of the arm is in contact with the fixed member of a hoistway. When the actuator is in the retracted position, the arm is moved into the disengaged position such that the at least the portion of the arm is free from contact with the fixed member of the elevator assembly.

17 Claims, 10 Drawing Sheets

(56) References Cited

U.S. PATENT DOCUMENTS

| | | | | |
|---|---|---|---|---|
| 2009/0308697 | A1* | 12/2009 | Boschin | B66B 7/044 187/409 |
| 2014/0339025 | A1* | 11/2014 | Kocher | B66B 17/34 187/409 |
| 2017/0355563 | A1* | 12/2017 | Zimmerli | B66B 7/08 |
| 2018/0127238 | A1* | 5/2018 | Guo | B66B 7/041 |
| 2018/0194595 | A1* | 7/2018 | Li | B66B 7/042 |
| 2020/0207575 | A1* | 7/2020 | Koskinen | F16D 55/00 |
| 2020/0207576 | A1* | 7/2020 | Koskinen | B66B 5/0025 |
| 2020/0207582 | A1* | 7/2020 | Koskinen | B66B 17/34 |

FOREIGN PATENT DOCUMENTS

| | | | |
|---|---|---|---|
| CN | 205011197 | U | 2/2016 |
| CN | 205397800 | U | 7/2016 |
| CN | 107826934 | A | 3/2018 |
| CN | 207434800 | U | 6/2018 |
| CN | 107108171 | B | 5/2020 |
| CN | 111268533 | A | 6/2020 |
| CN | 211169659 | U | 8/2020 |
| CN | 106429937 | B | 10/2020 |
| CN | 107000994 | B | 10/2020 |
| EP | 1549582 | B1 | 10/2012 |
| EP | 1424302 | B2 | 9/2015 |
| EP | 2655233 | | 4/2017 |
| EP | 3372546 | B1 | 1/2020 |
| JP | 3018577 | B2 | 3/2000 |
| JP | 2004210423 | A * | 7/2004 |
| JP | 2004210423 | A | 7/2004 |
| JP | 4020470 | B2 | 12/2007 |
| JP | 4050466 | B2 | 2/2008 |
| JP | 2009208914 | A | 9/2009 |
| JP | 2012012226 | A | 1/2012 |
| JP | 5319712 | B2 | 10/2013 |
| JP | 5840501 | B2 | 1/2016 |
| JP | 6066067 | B2 | 1/2017 |
| JP | 6070959 | B2 | 2/2017 |
| JP | 6092319 | B2 | 3/2017 |
| KR | 904840 | B1 | 6/2009 |

* cited by examiner

STABILIZING ASSEMBLIES AND METHODS OF USE THEREOF

TECHNICAL FIELD

The present specification generally relates to a stabilizing device and, more specifically, to an elevator stabilizing device that engages with a fixed member of an elevator shaft.

BACKGROUND

It is known to use a plurality of suspension members, such as hoisting belts, or hoisting ropes, attached to an elevator cab of an elevator system to move the elevator cab between floors of a building within an elevator shaft or hoistway. The suspension members from which the elevator cab is suspended act as springs, with the spring effect becoming more pronounced as the length of the suspension members under tension increases between the traction sheave and the engagement point on the cab. In applications where the elevator cab travels a predetermined sufficient distance away from an overhead sheave from which the cab is suspended, the spring effect in the suspension members can become excessive and unacceptable. This distance combined with the natural frequency of the elevator system causes the elevator cab to bounce, or oscillate, during loading and unloading of passengers and cargo within the elevator cab. This bouncing or oscillating may trigger faults, cause issues with leveling, and/or be uncomfortable for passengers.

Accordingly, a need exists for elevator stabilizing assemblies for reducing the bouncing of the elevator cab.

SUMMARY

An elevator stabilizing assembly for dissipating energy in the vertical direction, so as to eliminate, dampen, or minimize bounce or oscillations in the cab hanging from the suspension members of an elevator assembly is provided. The elevator assembly has an elevator cab, a plurality of suspension members from which the elevator cab is suspended for raising and lowering the elevator cab within an elevator hoistway or elevator shaft, and a fixed member of the hoistway, such as a guide rail affixed to a wall of the hoistway. The plurality of suspension members move the elevator cab between a plurality of positions in the hoistway and the fixed member guides the elevator cab within the hoistway between the plurality of positions. The elevator stabilizing assembly includes an actuator and a stabilizing device. The actuator is configured to move between a retracted position and an extended position. The stabilizing device includes an arm and a biasing member. The biasing member is coupled to the arm and biases the arm to move the arm between a disengaged position and an engaged position. When the actuator is moved into the extended position, the arm is moved into the engaged position causing at least a portion of the arm or attached component to be brought into contact with the fixed member of the elevator assembly. When the actuator is moved from the extended position to the retracted position, the arm is moved into the disengaged position such that at least the portion of the arm that had been in contact with the fixed member is moved away from the fixed member, so as to now be free from contact with the fixed member of the elevator assembly.

An elevator stabilizing assembly for damping movement of a cab of an elevator assembly is provided. The elevator assembly has an elevator cab, a plurality of suspension members from which the elevator cab is suspended for raising and lowering the elevator cab within an elevator hoistway or elevator shaft, and a fixed member of the hoistway such as a guide rail affixed to a wall of the hoistway. The plurality of suspension members move the elevator cab between a plurality of positions and the fixed member or guide rail guides the elevator cab within the hoistway between the plurality of positions. The elevator stabilizing assembly includes an actuator and a stabilizing device. The actuator is configured to move between a retracted position and an extended position. The stabilizing device includes a pair of spaced apart arms and a pair of engaging members. The pair of spaced apart arms are pivotally biased by a biasing member positioned between the pair of spaced apart arms to move the pair of spaced apart arms between a disengaged position and an engaged position. One of the pair of engaging members is coupled to one of the pair of spaced apart arms and the other one of the pair of engaging members is coupled to the other one of the pair of spaced apart arms. The elevator stabilizing assembly is configured to move between an unstabilized state and a stabilized state.

A method of operating an elevator stabilizing assembly for damping movement of an elevator assembly is provided. The method includes the steps of receiving, by a processing device, a signal indicating one of a door of an elevator cab is not in a closed position, is about to be opened, is opening, or is in an open position, moving, by the processing device, an actuator from a retracted position to an extended position, and moving, by the actuator, a pair of spaced apart arms from a disengaged position to an engaged position such that a pair of engaging members coupled to a distal end of the pair of spaced apart arms are in contact with a fixed member of a hoistway of the elevator assembly to dampen the movement of the elevator cab while the cab is stopped at a floor in the shaft.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein are directed to an elevator assembly that includes an elevator stabilizing assembly, and method of use thereof, for damping, braking movement of an elevator cab of the elevator assembly, and/or dissipating energy. Specifically, the elevator cab of the elevator assembly may oscillate, or bounce while suspended from one or more suspension member(s) under tension, when the elevator cab of the elevator assembly is loaded with passengers or cargo and the length of each suspension member under tension between a traction sheave and an elevator cab has reached a predetermined length. The elevator stabilizing assembly may move between a stabilized state and an unstabilized state to selectively engage a fixed member of a hoistway of the elevator assembly, such as a guide rail, or other fixed rail or structure located in the hoistway, to reduce the oscillation, or bounce, of the elevator cab by applying a frictional force to the fixed member in the direction of oscillation or bounce. As such, when the elevator stabilizing assembly is in the stabilized state, the elevator stabilizing assembly damps, brakes the movement of the elevator cab, and/or dissipates energy, to reduce or minimize any vertical oscillating or bouncing that would otherwise occur.

The elevator stabilizing assembly includes a stabilizing device and an actuator coupled to the stabilizing device. The stabilizing device may include a pair of spaced apart arms, a pair of engaging members coupled to the pair of arms, and a biasing member positioned between the pair of arms that biases the pair of arms between a disengaged position and an engaged position. The actuator is configured to move the stabilizing device between a retracted position and an extended position. When the actuator moves the stabilizing device to the extended position, the pair of arms are moved into the engaged position such that the pair of engaging members engage and make contact with the fixed member of the hoistway. As such, in the engaged position, the engaging members each provide a frictional force between the engaging members and the fixed member. In one embodiment, the frictional force will be directed vertically to oppose vertical oscillation or bounce of the cab in a vertical shaft. In other embodiments, the frictional force will generally be directed in the direction of oscillation or bounce that would otherwise be experienced by the cab. The biasing member biases the pair of engaging members toward the fixed member, thereby increasing the magnitude of the resulting frictional force and decreasing the amount of oscillation or bounce experienced by the elevator cab hanging from the suspension member.

Figure 2:
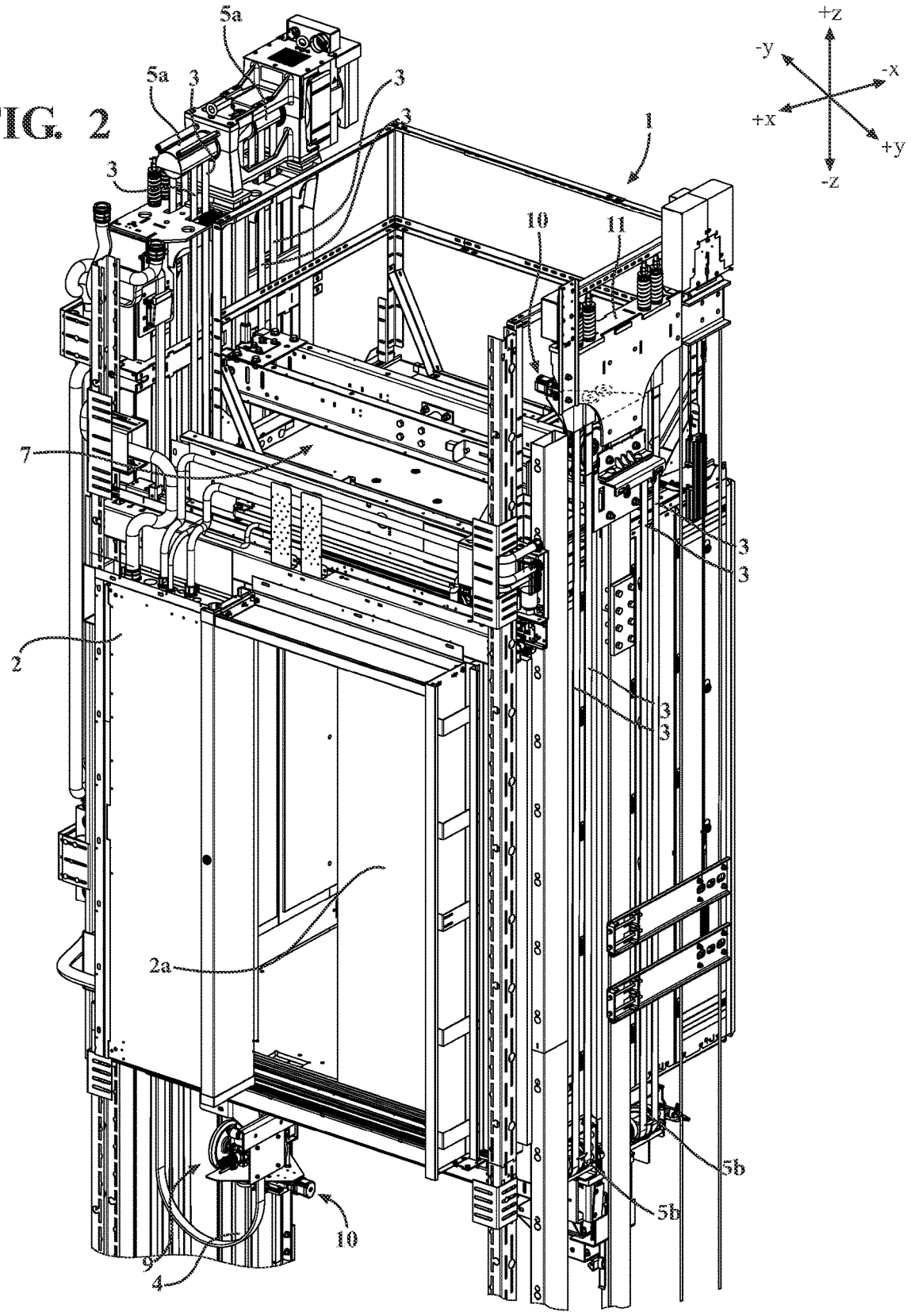
FIG. 2 schematically depicts an environmental view of an elevator assembly and an elevator stabilizing assembly of the first aspect of the elevator assembly of FIG. 1A, according to one or more embodiments shown and described herein.

As used herein, the term "longitudinal direction" refers to the forward-rearward direction of the elevator stabilizing assembly (i.e., in a +/−Y direction of the coordinate axes depicted in FIG. 2). The term "lateral direction" refers to the cross-direction (i.e., along the X axis of the coordinate axes depicted in FIG. 2), and is transverse to the longitudinal direction. The term "vertical direction" refers to the upward-downward direction of the elevator stabilizing assembly (i.e., in the +/−Z direction of the coordinate axes depicted in FIG. 2). As used herein, "upper" is defined as generally being towards the positive Z direction of the coordinate axes shown in the drawings. "Lower" is defined as generally being towards the negative Z direction of the coordinate axes shown in the drawings.

As used herein, the term "communicatively coupled" means that coupled components are capable of exchanging data signals and/or electric signals with one another such as, for example, electrical signals via conductive medium, electromagnetic signals via air, optical signals via optical waveguides, electrical energy via conductive medium or a non-conductive medium, data signals wirelessly and/or via conductive medium or a non-conductive medium and the like.

Figure 1A:
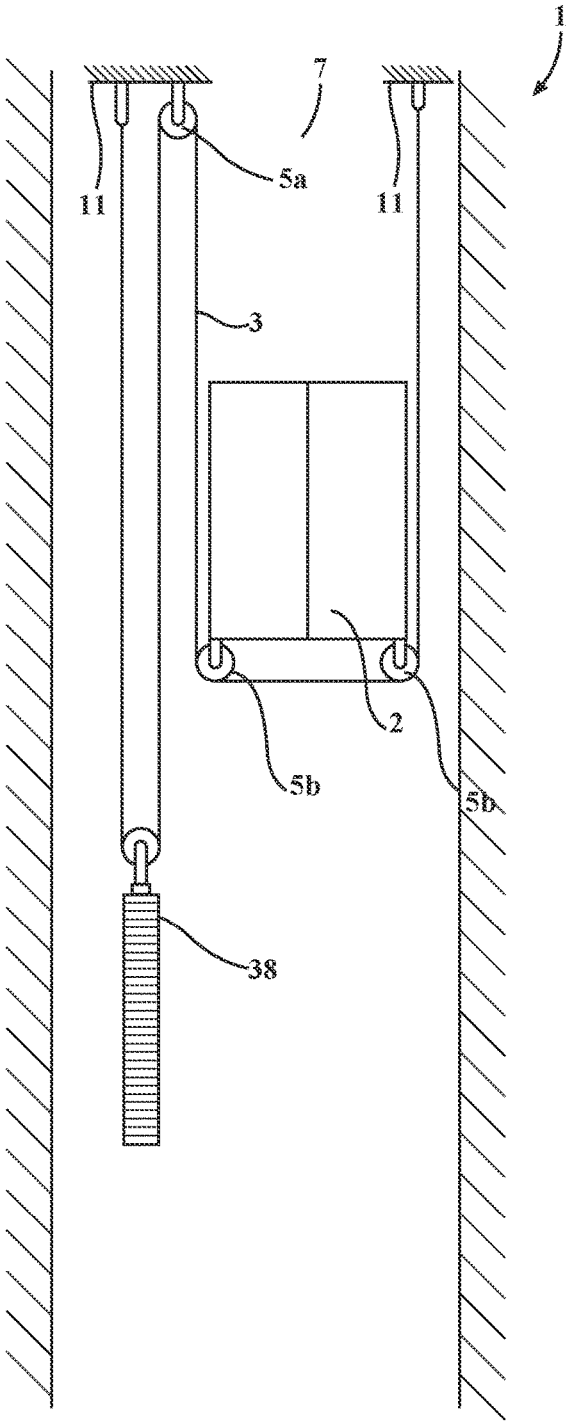
FIG. 1A schematically depicts a first aspect of an elevator assembly schematic, according to one or more embodiments shown and described herein.

Referring now to FIG. 1A, an elevator assembly schematic that illustrates various components for a first aspect of an elevator assembly 1 is depicted. In this aspect, the elevator assembly 1 may include an elevator cab 2, a plurality of suspension members 3 illustrated for schematic reasons as a single suspension member, a hoistway 7 or elevator shaft, a traction sheave 5*a*, a pair of idler sheaves 5*b*, a rail cap 11 and a counterweight 38. In this aspect, the plurality of suspension members 3 extend a length between two different rail caps 11. Further, in this aspect, the traction sheave 5*a*, for example, is mounted to the rail cap 11 positioned in an upper portion of the hoistway 7 above the elevator cab 2 in a vertical direction (i.e., in the +/−Z direction). This is non-limiting, and the traction sheave 5*a* may be mounted anywhere within the hoistway 7 and there may be more than one traction sheaves 5*a*.

The traction sheave 5*a* may include a motor such that the traction sheave 5*a* is a device to drive the plurality of suspension members 3 through a plurality of lengths between the elevator cab 2 and the traction sheave 5*a*. The idler sheaves 5*b* may also be mounted at various positions in the hoistway 7, and, in this aspect, are also coupled to the elevator car 2. The idler sheaves 5*b* are passive (they do not drive the plurality of suspension members 3 but rather guide or route the plurality of suspension members 3) and form a contact point, or engagement point, with the elevator cab 2. The plurality of suspension members 3 and the traction sheave 5*a* move the elevator cab 2 between a plurality of positions within the hoistway 7.

As illustrated in FIG. 1A, the elevator assembly 1 is an underslung system. That is, each of the plurality of suspension members 3 may be movably coupled to the traction sheave 5*a* and a portion of the suspension members 3 may be coupled to a bottom surface of the elevator cab 2 to suspend the elevator cab 2 via the idler sheaves 5*b*. As such, the suspension members 3 pass under the elevator cab 2 on a bottom of the elevator cab 2 via the idler sheaves 5*b*, and are coupled to a dead end hitch or the rail cap 11 at the top of the hoistway 7 under tension.

As used herein the "length of each suspension member" or "length of the plurality of suspension members" means a length of each of the plurality of suspension members 3 from the traction sheave 5*a* to the contact point with the elevator cab 2. As such, in the first aspect, the "length of the suspension member" is the length of each of the plurality of suspension members 3 between the traction sheave 5*a* and the pair of idler sheaves 5*b* positioned as the contact point with the elevator cab 2.

Figure 1B:
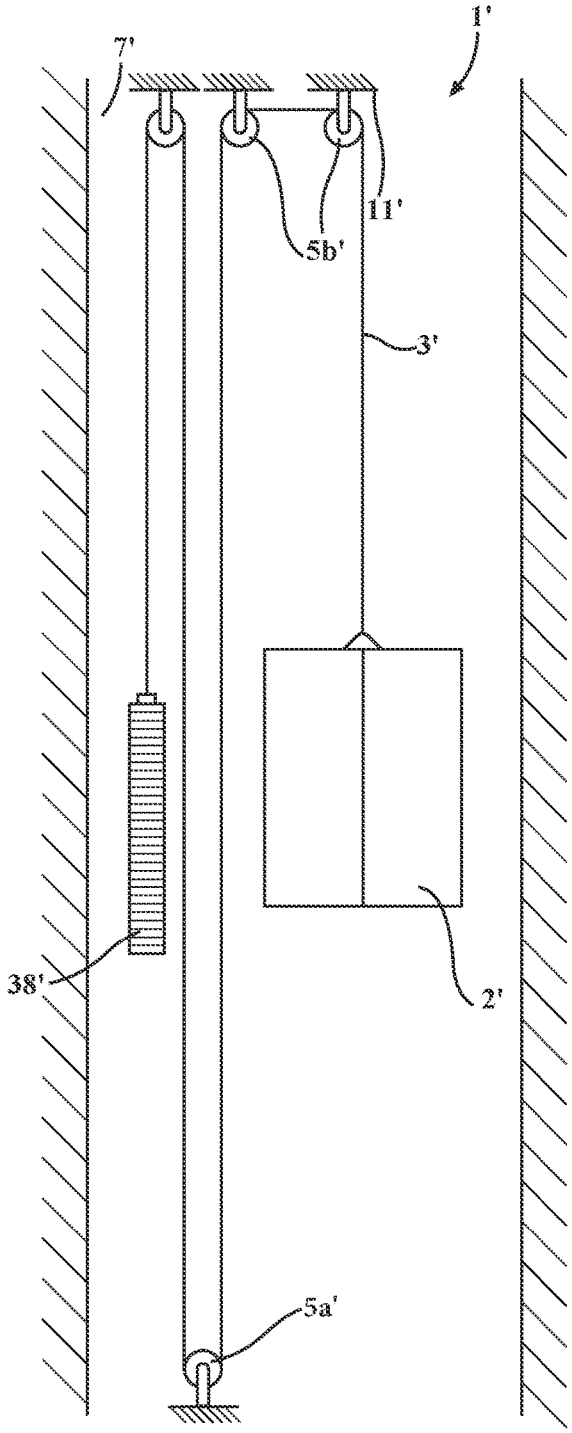
FIG. 1B schematically depicts a second aspect of an elevator assembly schematic, according to one or more embodiments shown and described herein.

Referring now to FIG. 1B, a schematic illustrates various components for a second aspect of an elevator assembly 1' is depicted. In this aspect, the elevator assembly 1' may include an elevator cab 2', a plurality of suspension members 3' illustrated for schematic reasons as a single suspension member, a hoistway 7' or elevator shaft, a traction sheave 5*a*', a pair of idler sheaves 5*b*', a rail cap 11' and a counterweight 38'. In this aspect, the plurality of suspension members 3' extend a length between the counterweight 38' and the elevator cab 2'. Further, in this aspect, the traction sheave 5*a*', for example, is mounted to a lower surface of the hoistway 7'. This is non-limiting, and the traction sheave 5*a*' may be mounted anywhere within the hoistway 7' and there may be more than one traction sheaves 5*a*'. The traction sheave 5*a*' may include a motor such that the traction sheave 5*a*' is a device to drive the plurality of suspension members 3' through a plurality of lengths with respect to the length between the traction sheave 5*a*' and the contact point of the elevator cab 2'. The idler sheaves 5*b*' may also be mounted at various positions in the hoistway 7', and, in this aspect, are also coupled to a rail cap 11'. The idler sheaves 5*b*' are passive (they do not drive the plurality of suspension members 3 but rather guide or route the plurality of suspension members 3'). The plurality of suspension members 3' are coupled to the elevator cab 2' to form the contact point. As such, in the second aspect, the length of each suspension member 3' in the elevator assembly 1' is from the traction sheave 5*a*' to the contact point with the elevator cab 2'.

It should be appreciated that the illustrated schematics of FIGS. 1A-1B are merely examples and that the suspension members routing may be vary significantly or slightly from these illustrated schematics. For example, there may be several idler sheaves positioned in the hoistway between the traction sheave and the contact point with the elevator cab. However, regardless of the suspension member routing and the number of components (e.g. idler sheaves) the length of each suspension member as used herein is between the traction sheave and the contact point with the elevator cab.

Figure 3:
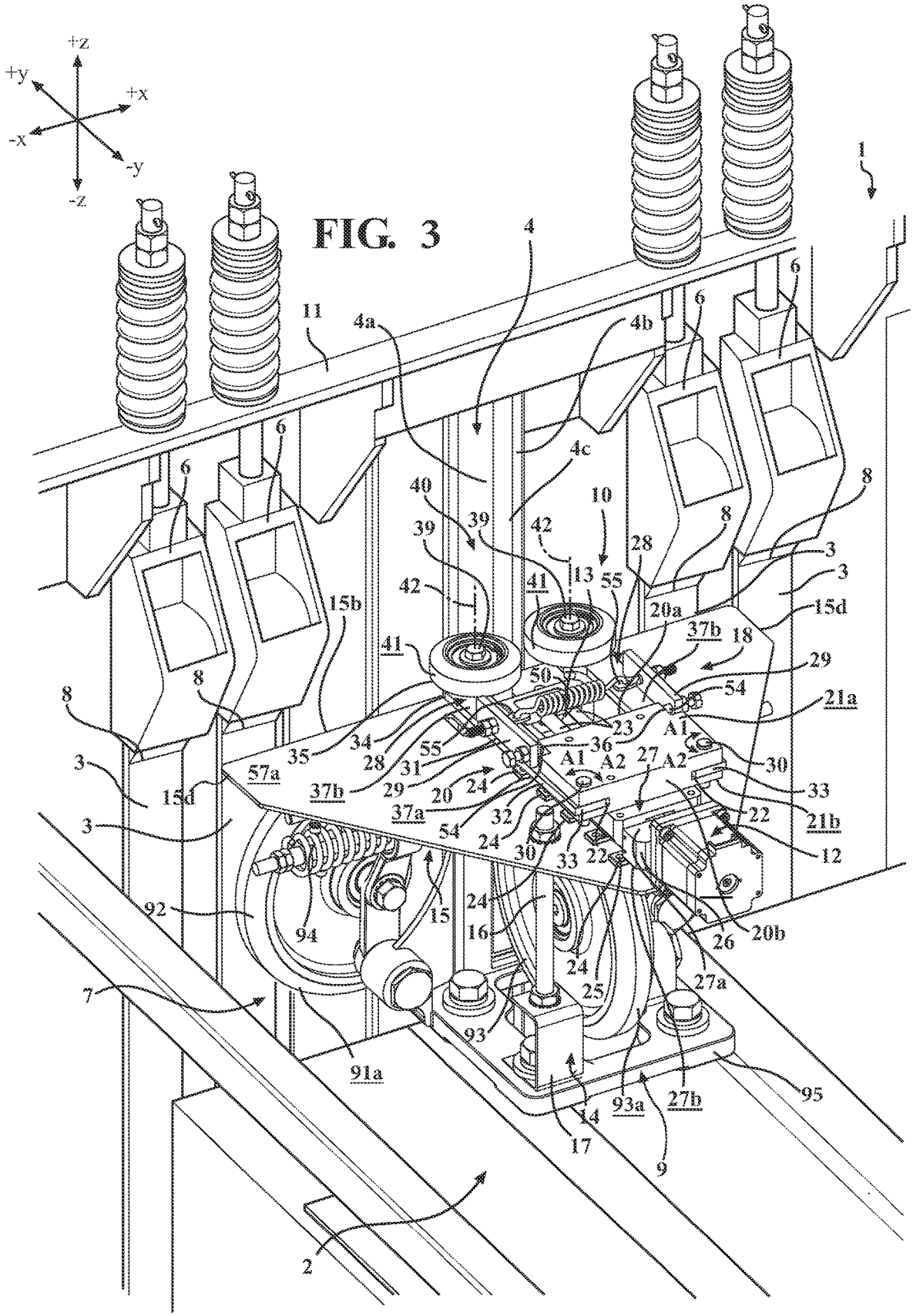
FIG. 3 schematically depicts a partial isolated perspective view of the elevator assembly and the elevator stabilizing assembly of FIG. 2, according to one or more embodiments shown and described herein.
Figure 8:
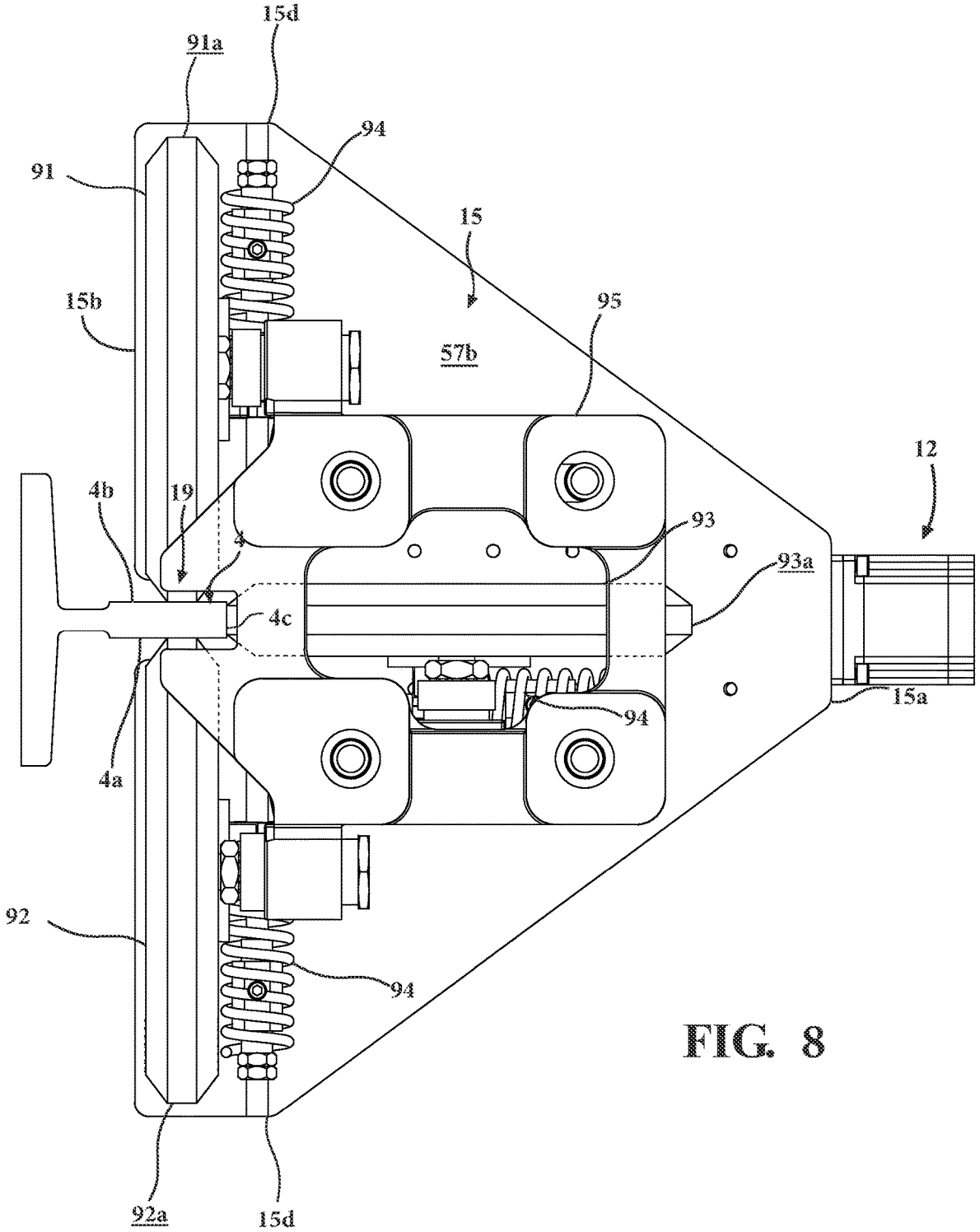
FIG. 8 schematically depicts a bottom view of the elevator stabilizing assembly of FIG. 2, according to one or more embodiments shown and described herein.

Referring now to FIGS. 2, 3 and 8, an environmental view of the elevator assembly 1 is schematically depicted. For brevity reason, embodiments described herein are directed to the elevator assembly 1 of FIG. 1A, however, it should be appreciated that this is non-limiting and embodiments may be directed to the elevator system 1' of FIG. 1B, and/or other elevator assemblies not illustrated herein.

As discussed with respect to FIG. 1A, the elevator assembly 1 may include the elevator cab 2, the plurality of suspension members 3, such as suspension belts (as depicted in the drawing figures), ropes, cables, and the like, a fixed member 4 of the hoistway 7 or elevator shaft, such as for example a guide rail 4, the traction sheave 5*a*, the pair of idler sheaves 5*b*, a roller guide assembly 9 having a plurality of guide wheels 91, 92, 93 that ride on the guide rail 4, and the rail cap 11. The fixed member, or guide rail 4, includes a pair of opposing side surfaces 4*a*, 4*b* defining a width W (FIG. 5) there between, and a fore surface 4*c* that may face the elevator cab 2. Each of the plurality of suspension members 3 have a distal end (not shown) and an opposite proximate end 8. Further, in some embodiments, the plurality of suspension members 3 may include any number of suspension members, such as four spaced-apart suspension members as depicted in FIGS. 2 and 3. In other embodiments, there may be more or less than four spaced apart suspension members.

As such, in this embodiment, a proximate end 8 of the suspension members 3 are fixedly coupled to the rail cap 11 and the movably coupled portion of the suspension members 3 are under tension to move the elevator cab 2 between various landings. The rail cap 11 may be opposite the traction sheave 5*a* in the hoistway 7, such that the elevator cab 2 is positioned between the traction sheave 5*a* and the rail cap 11. In operation, a rotation of the traction sheave 5*a* moves the suspension members 3, which in turn move the elevator cab 2 between landings. In some embodiments, the movement of the suspension members 3 is in the vertical direction (i.e., in the +/−Z direction). In other embodiments, the movement of the suspension members 3 is in the longitudinal direction (i.e., in a +/−Y direction) and/or in the lateral direction (i.e., in the X direction), or combinations thereof.

In other embodiments, the plurality of suspension members 3 may be coupled, or connected, to the elevator cab 2 at a top or upper surface of the elevator cab 2, such as depicted in FIG. 1B. For example, the suspension members 3 may be connected to the elevator cab 2 via, a pulley (not shown) and extend to a counterweight 38 (FIGS. 1A-1B such that rotation of the traction sheave 5*a* moves the suspension members 3 over the pulley to the counterweight, thereby moving the elevator cab 2, such as by raising or lowering the elevator cab 2 between landings. The suspension members 3 may extend downward from the traction sheave 5*a* to the elevator cab 2, movably coupled to the elevator cab 2 in the front-rear direction, and extend upward from the elevator cab 2 to the rail cap 11.

In the embodiment shown in FIG. 2, a length of the plurality of suspension members 3 under tension, between the traction sheave 5*a* and the contact point of the elevator cab 2, increases when the elevator cab 2 moves away from the traction sheave 5. Depending on the position, or location, of the traction sheave 5*a*, some movement of the elevator cab 2 may position the elevator cab 2 closer to the traction sheave 5*a* while increasing the length of the plurality of suspension members 3. For example, when the traction sheave 5*a* is positioned near the bottom of the hoistway 7, the length of the suspension members 3 under tension between the traction sheave 5*a* and the elevator cab 2 will be longer when the elevator cab 2 is at a lower level, or landing, of the building and the elevator cab 2 is moving closer to the traction sheave 5*a*. Alternatively, when the traction sheave 5*a* is positioned near the top of the hoistway 7, the distance or length of the suspension members 3 will be longer when the elevator cab 2 is positioned at a lower level, or landing, of the building than when at a higher level, or landing, of the building and the elevator cab 2 is moving away from the traction sheave 5*a*.

The plurality of tensioners 6 are each configured to adjust a tension of the corresponding suspension member of the plurality of suspension members 3. It should be understood that the plurality of suspension members 3 described herein are not limited to any particular suspension member type or construction, and may be, or may include, ropes, cables, belts, or alternative forms and/or configuration of suspension members, any one of which can be made of steel wires, aramid fibers, carbon fiber, fiberglass, other composites, or combinations thereof, and/or the like. Belts in particular, without limitation, may be any one of steel corded belts, aramid corded belts, carbon fiber belts, or other similar composite belts, having a plurality of internal cords or fibers, embedded within a polymer matrix or an outer polymer jacket of rubber, PVC and PVG, combinations thereof, similar polymers, and/or the like.

The plurality of suspension members 3, and/or other components known to those skilled in the art, may be configured to move the elevator cab 2 between a plurality of positions. For example, in some embodiments, the plurality of suspension members 3 may raise and lower the elevator cab 2 in a vertical direction (i.e., in the +/−Z direction) between floors in a building. In other embodiments, the plurality of suspension members 3 may move the elevator cab 2 in a lateral direction (i.e., in the +/−X direction), a longitudinal direction (i.e., in the +/−Y direction), or a direction transverse to one or more of the vertical, lateral or longitudinal directions, between a plurality of positions. The guide rail 4 may be fixed to various portions of the hoistway 7 and be configured to guide the elevator cab 2 between the plurality of positions. The guide rail 4 may locate the elevator cab 2 within the hoistway 7 in the lateral direction (i.e., in the +/−X direction), the longitudinal direction (i.e., in the +/−Y direction), the vertical direction (i.e., in the +/−Z direction), or any combination thereof. Further, in some embodiments, the elevator assembly 1 may include a pair of spaced apart guide rails 4.

The elevator cab 2 may include a door 2*a*, a gate, a barrier, or the like, that moves between an open position and a closed position. In the open position, a user may enter or exit the elevator cab 2. In the closed position, access may be denied to enter or exit the elevator cab 2. The elevator assembly 1 may act similarly to a traditional elevator assembly. That is, in some embodiments, the elevator cab 2 may move from one floor to another floor under the power of a motor applied to the traction sheave 5*a*, using the guide rail 4, the roller guide assembly 9, and the plurality of suspension members 3. Further, the elevator assembly 1 may move the door 2*a* from the closed position to the open position when positioned at the another floor. In other embodiments where the elevator cab 2 moves in the lateral direction (i.e., in the +/−X direction) or longitudinal direction (i.e., in the +/−Y direction), the elevator cab 2 may move between a plurality of positions, moving the door 2*a* from the closed position to the open position when positioned at one of the plurality of positions.

Referring to FIGS. 2, 3 and 8, the roller guide assembly 9 may include a mounting base 95, a pair of opposing wheels 91, 92, a fore wheel 93, and biasing members 94. The pair of opposing wheels 91, 92 may be configured to contact the pair of opposing side surfaces 4*a*, 4*b* of the guide rail 4, respectively. The fore wheel 93 may be disposed transverse to the pair of opposing wheels 91, 92. Further, the fore wheel 93 may be configured to contact the fore surface 4*c* of the guide rail 4. Biasing members 94 may each include an axle that couples the pair of opposing wheels 91, 92, and the fore wheel 93 to the mounting base 95 and to bias each of the respective pair of opposing wheels 91, 92, and the fore wheel 93 toward the respective contact surface of the guide rail 4. For example, the biasing member 94 coupled to the fore wheel 93 biases the fore wheel 93 in the longitudinal direction (e.g., in the +/−Y direction) into the fore surface 4*c* of the guide rail 4. The biasing members 94 coupled to the pair of opposing wheels 91, 92 bias the wheels toward the guide rail 4, and toward one another. One of the pair of opposing wheels 91 may include an outer surface 91*a* that contacts the side surface 4*a* of the guide rail 4. The other of the pair of opposing wheels 92 may include an outer surface 92*a* that contacts the side surface 4*b* of the guide rail 4. The fore wheel 93 may include an outer surface 93*a* that contacts the fore surface 4*c* of the guide rail 4.

Figure 4:
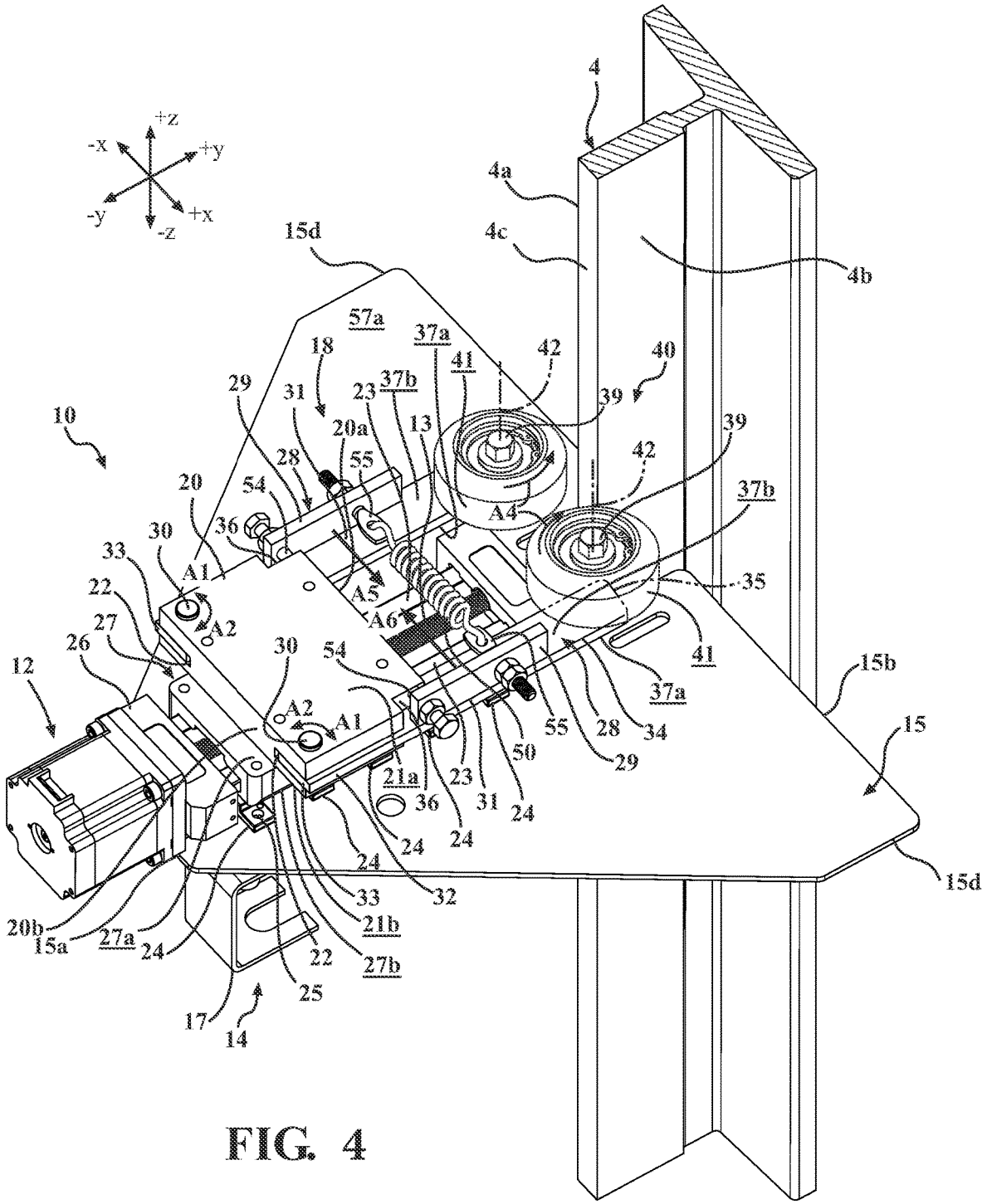
FIG. 4 schematically depicts an isolated perspective view of the elevator stabilizing assembly of FIG. 2 in an unstabilized state, according to one or more embodiments shown and described herein.
Figure 5:
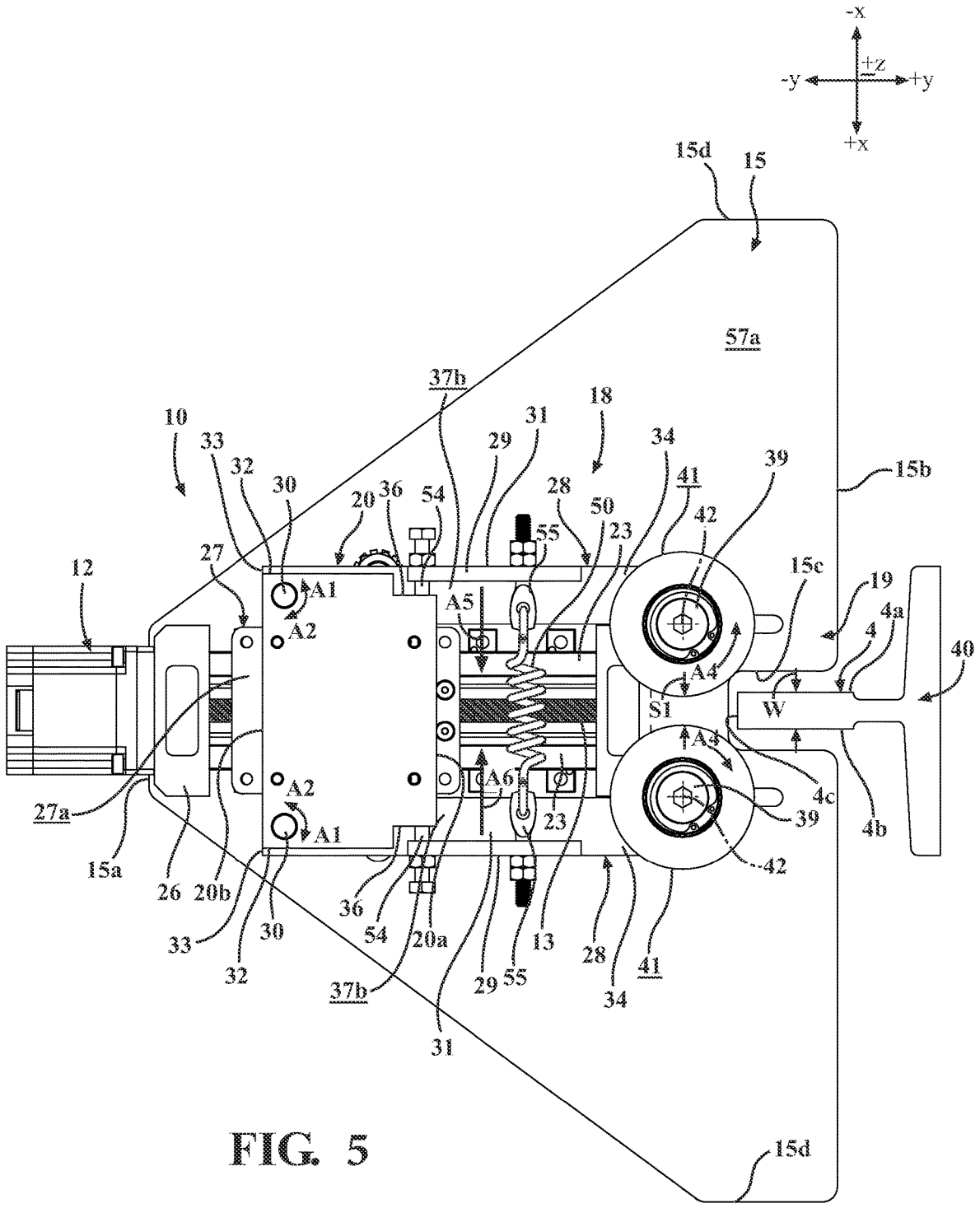
FIG. 5 schematically depicts an isolated top view of the elevator stabilizing assembly of FIG. 4, according to one or more embodiments shown and described herein.
Figure 6:
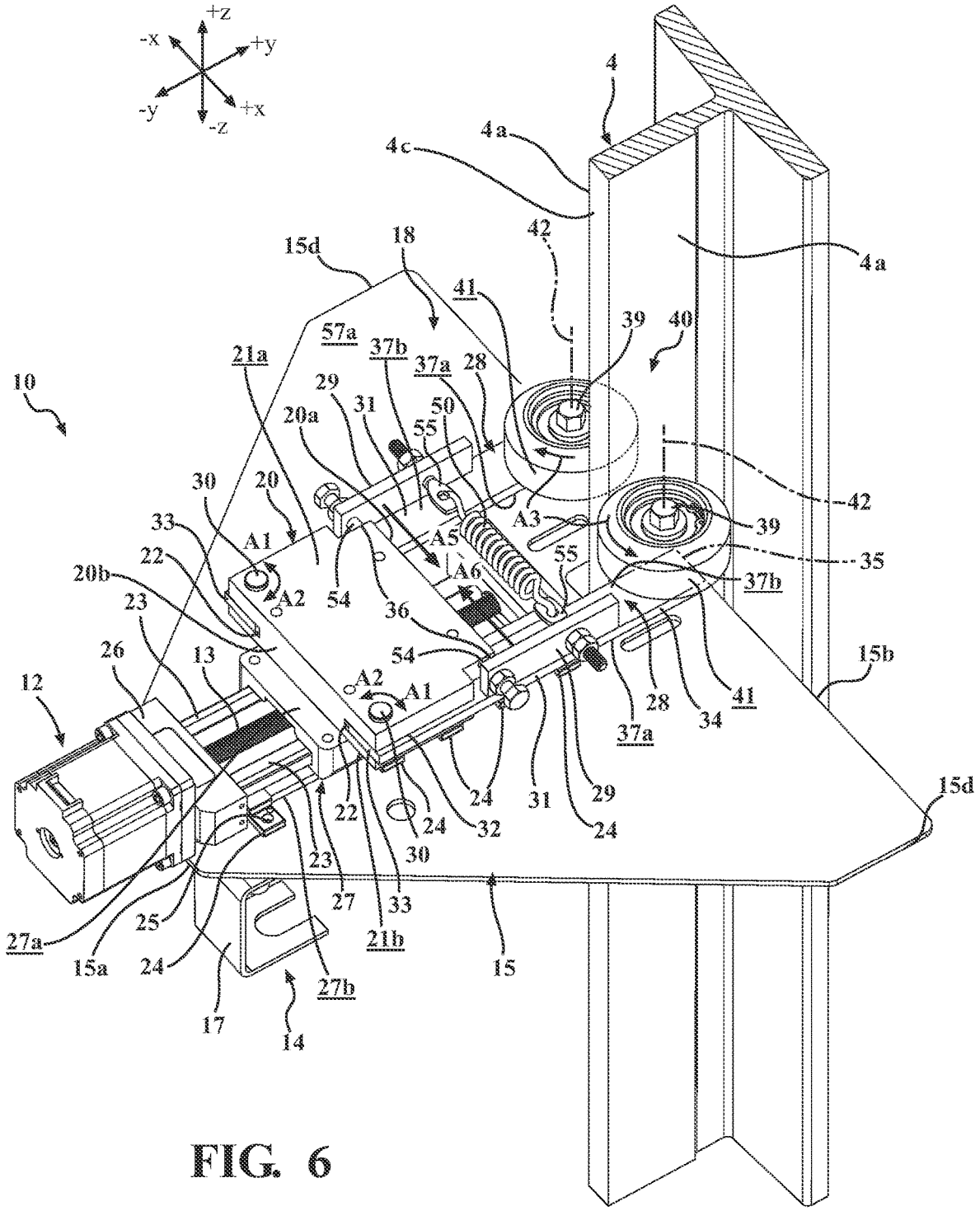
FIG. 6 schematically depicts an isolated perspective view of the elevator stabilizing assembly of FIG. 2 in a stabilized state, according to one or more embodiments shown and described herein.
Figure 7:
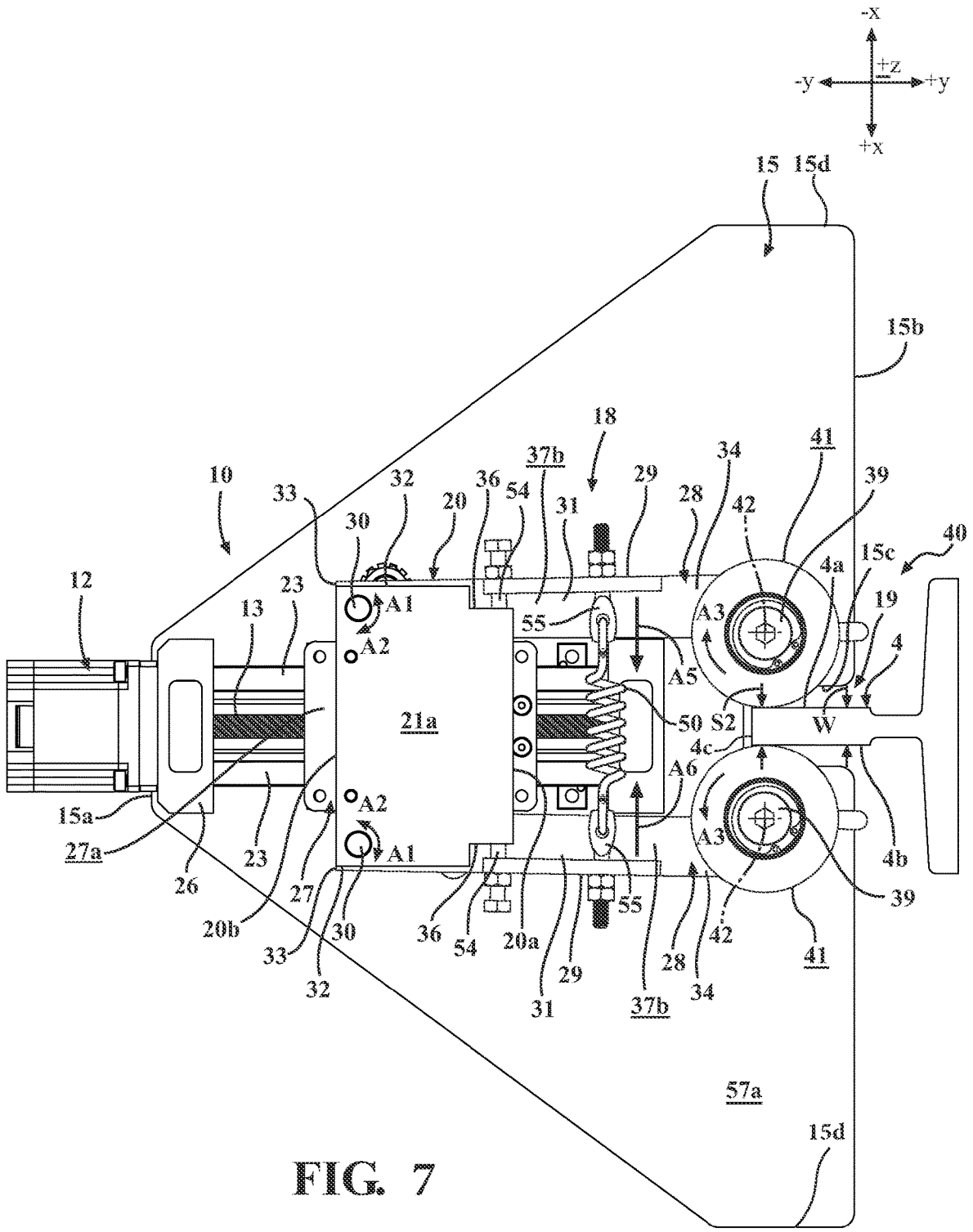
FIG. 7 schematically depicts a top view of the elevator stabilizing assembly of FIG. 6, according to one or more embodiments shown and described herein.

Now referring to FIGS. 1A and 2-8, the elevator assembly 1 further includes an elevator stabilizing assembly 10. The elevator stabilizing assembly 10 may move between a stabilized state, where the elevator stabilizing assembly 10 engages with the guide rail 4 of the elevator assembly 1, as best shown in FIGS. 6-7, and an unstabilized state, where the elevator stabilizing assembly 10 is disengaged from the guide rail 4 of the elevator assembly 1, as best shown in FIGS. 4-5. The elevator stabilizing assembly 10 may include an actuator 12, a mounting member 14, and a stabilizing device 18. The mounting member 14 may include a platform 15, an elongated member 16, such as a rod, and a mounting bracket 17 for mounting or coupling the platform 15 to the elevator cab 2. The platform 15 and the mounting bracket 17 may be coupled to the elongated member 16 with the elongated member 16 positioned between the platform 15 and the mounting bracket 17. In embodiments, the elevator assembly 1 may include at least one elevator stabilizing assembly 10. The at least one elevator stabilizing assembly 10 may be positioned in either direction of travel. For example, in embodiments where the elevator cab 2 travels in a vertical direction (e.g., in the +/−Z direction), at least one the elevator stabilizing assembly 10 may be positioned above the elevator cab 2, below the elevator cab 2, or both. While the elevator assembly 1 depicted in FIG. 2 includes two elevator stabilizing assemblies 10, the elevator assembly 1 may include any number of elevator stabilizing assemblies 10, such as, for example, one, two, three, four, five, or the like.

Now referring to FIGS. 5, 7 and 8, the platform 15 may extend perpendicularly with respect to the travel or direction of extension of the guide rail 4. The platform 15 includes a leading edge 15*a* and a terminating edge 15*b*, which is closest to the guide rail 4, a pair of side edges 15*d* at the longitudinal ends of the terminating edge 15*b*, and may include an upper surface 57*a* and an opposite inner surface 57*b* that may both be planar. The inner surface 57*b* may face in a direction towards the elevator cab 2 and the roller guide assembly 9 while the upper surface 57*a* faces in a direction away from the elevator cab 2 and the roller guide assembly 9. The platform 15 may further include a notch 19 formed at the terminating edge 15*b*. The notch 19 includes an inner edge surface 15*c*. The platform 15 may be positioned adjacent the guide rail 4 such that the portions of the guide rail 4 extend into the notch 19 of the platform 15. As such, the notch 19 may be shaped to accommodate a geometry of the guide rail 4.

Now referring to FIGS. 3 and 8, in some embodiments, the platform 15 is mounted or coupled to the roller guide assembly 9. That is, the platform 15 is mounted or coupled above the roller guide assembly 9 in the vertical direction (i.e., in the +/−Z direction). The mounting bracket 17 may be coupled to the mounting base 95 of the roller guide assembly 9 such as, for example, by a fastener. The platform 15 may be shaped such that the side edges 15*d* of the platform 15 extend beyond the outer surfaces 91*a*, 92*a* of the pair of opposing wheels 91, 92, respectively, so that the platform 15 covers the pair of opposing wheels 91, 92. Additionally, the platform 15 may be shaped such that the leading edge 15*a* of the platform 15 extends beyond the outer surface 93*a* of the fore wheel 93 to cover the fore wheel 93. The platform 15 may be a guard preventing access to the roller guide assembly 9. In some embodiments, the platform 15 may prevent debris from contacting the guide wheels 92, 93, or from being positioned between the guide wheels 91, 92, 93 and the guide rail 4. In other embodiments, the roller guide assembly 9 is mounted to other components of the elevator assembly 1.

Now referring back to FIGS. 3-7, in embodiments, the platform 15 and the mounting bracket 17 may be coupled to the elongated member 16 via fasteners, such as bolt and nut, rivet, screw, welding, epoxy, adhesive, and/or the like. The mounting bracket 17 may be coupled to the elevator cab 2 via fasteners, such as a bolt and nut, rivet, screw, welding, epoxy, adhesive, and/or the like. The platform 15 may be spaced apart from the elevator cab 2 via a vertical length of the elongated member 16. That is, the length of the elongated member 16 in the vertical direction (i.e., in the +/−Z direction) may determine the distance the platform 15 is spaced apart from the elevator cab 2. The actuator 12, the stabilizing device 18, or both, may be coupled to the platform 15 of the mounting member 14.

In embodiments, the actuator 12, the stabilizing device 18, or both, may be coupled to the upper surface 57 of the platform 15 between the leading edge 15*a* and the terminating edge 15*b* via fasteners, such as bolt and nut, rivet, screw, welding, epoxy, adhesive, and/or the like. As such, the mounting member 14 may couple the platform 15, and the elevator stabilizing assembly 10, to the elevator cab 2.

The actuator 12 may include an actuating member 13, a pair of slide rails 23, a frame 26, and a support member 27. The actuating member 13 may be moved by the actuator 12. In some embodiments, the movement may be by rotation. In other embodiments, the movement may be linear or any other movement. In embodiments, the actuating member 13 may be a threaded rod. The frame 26 and the actuator 12 may each include a plurality of mounting tabs 24. Each of the plurality of mounting tabs 24 includes a bore 25 extending through each of the plurality of mounting tabs 24. Each bore 25 is configured to receive a fastener, such as bolt and nut, a screw, a rivet, and/or the like. The frame 26 may be coupled to the upper surface 57 of the platform 15 via the plurality of mounting tabs 24. However, the frame 26 may be coupled to the different surfaces of the platform 15, and in any other manner, such as via welding, adhesive, epoxy, and/or the like.

Still referring to FIGS. 3-7, the support member 27 may include an upper surface 27*a* and an opposite lower surface 27*b*. The upper surface 27*a* may be contoured or may be a planar surface, a receiving groove, and/or the like. The support member 27 may be movably coupled to the pair of slide rails 23, such that the support member 27 may translate in the longitudinal direction (i.e., in the +/−Y direction). The support member 27 may be threadably engaged with the actuating member 13 such that movement of the actuating member 13, by the actuator 12, moves the support member 27 in the longitudinal direction (e.g., in the +/−Y direction).

The stabilizing device 18 may be coupled to the support member 27 of the actuator 12. The actuator 12 may be configured to move between a retracted position, as best shown in FIGS. 4-5, and an extended position, as best shown in FIGS. 6-7, thereby moving the stabilizing device 18 in the longitudinal direction (e.g., in the +/−Y direction). In some embodiments, the actuator 12 may move in a rotational direction. In other embodiments, the actuator 12 may move in a linear direction. When moving from the retracted position to the extended position, the actuator 12 moves the stabilizing device 18 in the longitudinal direction toward the guide rail 4 (i.e., in the +Y direction) to allow the stabilizing device 18 to engage the guide rail 4, as discussed in greater detail herein. When moving from the extended position to the retracted position, the actuator 12 moves the stabilizing device 18 in the longitudinal direction away from the guide rail 4 (i.e., in the −Y direction) to disengage from the guide rail 4, as discussed in greater detail herein.

In some embodiments, the actuator 12 may be driven by an electric motor. In other embodiments, the actuator 12 may be a stepper motor, a hydraulic cylinder, a pneumatic cylinder, a magnet actuator, a mechanical actuator, or the like. Further, the actuator 12 may move linearly in the lateral direction (e.g., in the +/−X direction) and/or longitudinal direction (e.g., in the +/−Y direction), such as with a linear actuator. However, in embodiments, the actuator 12 may move rotationally, such as with a rotary actuator. In embodiments including a rotary actuator, the actuator 12 may rotate various components to move the stabilizing device 18 into contact with the guide rail 4.

The stabilizing device 18 may include a base member 20, a pair of arms 28, a biasing member 50, a pair of engaging members 40, and a pair of spacers 54. The base member 20 may include a first end 20*a* and an opposite second end 20*b*. Further, the base member 20 may include an upper surface 21*a* spaced apart from a lower surface 21*b* to define a thickness. A pair of elongated slots 22 extend at least partially through the base member 20 in a lateral direction (e.g., in the +/−X direction), and extend from a first end 20*a* of the base member 20 to an opposite second end 20*b* between the upper surface 21*a* and the lower surface 21*b*. Further, the base member 20 may include a pair of notches 36 that are positioned at the first end 20*a*. In some embodiments, the pair of notches 36 extend partially through the base member 20. That is, each of the pair of notches 36 extend through the upper surface 21*a* to the opening for the pair of elongated slots 22 in the vertical direction (i.e., in the +/−Z direction).

Still referring to FIGS. 3-7, in some embodiments, the base member 20 may be substantially rectangular. In other embodiments, the base member 20 may include any shape, such as circular, triangular, rectangular, hexagonal, and/or the like. The lower surface 21*b* of the base member 20 may be coupled to the support member 27 of the actuator 12. That is, the upper surface 27*a* of the support member 27 may support the base member 20. The upper surface 27*a* of the support member 27 may be shaped to be complementary to and receive the shape of the lower surface 21*b* of the base member 20. The base member 20 may be coupled to the support member 27 via a fastener, such as a bolt and nut, screw, rivet, hook and loop, welding, epoxy, adhesive, and/or the like. Further, the base member 20 may be formed of any material, including a metal, such as steel, aluminum, copper, and/or the like, a polymer, a composite, a plastic, a resin, and/or the like.

Each of the pair of arms 28 may include a first end 33 and an opposite second end 35. Further, each of the pair of arms 28 may include a first portion 32 positioned adjacent to or near the first end 33 and a second portion 34 that is positioned adjacent to, or near, the second end 35. The first portion 32 is spaced apart from the second portion 34 by a middle portion 31. Each of the pair of arms 28 may be positioned partially within a respective elongated slot of the pair of elongated slots 22 in the base member 20. Further, each of the pair of arms 28 extend away from the base member 20 in the longitudinal direction (i.e., in the +/−Y direction).

The first portion 32 of each of the pair of arms 28 may be positioned within the pair of elongated slots 22 such that the first end 33 of each of the pair of arms 28 terminates adjacent the second end 20*b* of the base member 20. The first portion 32 of each of the pair of arms 28 may be pivotally coupled to the base member 20 via one of a pair of pivot members 30. Each of the pair of pivot members 30 may extend in the vertical direction (i.e., in the +/−Z direction) and extend through the pair of elongated slots 22, the first portion 32 of each of the pair of arms 28, and the upper surface 21*a* and the lower surface 21*b* of the base member 20. As such, in some embodiments, each of the pair of pivot members 30 may be a pin, a rod, or other elongated body that may act as a pivot such that each of the first end 33 and the first portion 32 of each of the pair of arms 28 may pivot or rotate about each of the pair of pivot members 30 when moved between the engaged position and a disengaged position, as discussed in greater detail herein. Further, each of the pair of arms 28 are configured to move the pair of engaging members 40 into contact with the guide rail 4 or free of contact with the guide rail 4 when the pair of arms 28 are moved between the engaged position and a disengaged position, as discussed in greater detail herein.

Still referring to FIGS. 3-7, in some embodiments, the pair of arms 28 further include an inner surface 37*a* and an opposite exterior surface 37*b*. The inner surface 37*a* may face the platform 15 of the mounting member 14. In some embodiments, each of the pair of arms 28 further include a sidewall 29 that is coupled or attached to the exterior surface 37*b* at the middle portion 31. That is, the sidewall 29 is attached or coupled to the exterior surface 37*b* of the middle portion 31 between the first and second portions 32, 34. The sidewall 29 extends from the exterior surface 37*b* in the vertical direction (i.e., in the +/−Z direction). Further, in some embodiments, the sidewall 29 only extends a portion of the pair of arms 28 to not interfere, or overlap, with the first and second portions 32, 34. In some embodiments, the sidewall 29 is a monolithic structure with the corresponding arm of the pair of arms 28. In other embodiments, the sidewall 29 may be coupled or attached to the exterior surface 37*b* by a fastener, such as a nut and bolt, screw, rivet, epoxy, adhesive, weld and/or the like. In some embodiments, the pair of arms 28 are generally rectangular in shape with the inner and exterior surfaces 37*a*, 37*b* being substantially planar at the first and second portions 32, 34. The middle portion 31 and the sidewall 29 form an L-shaped cross section. In other embodiments, the pair of arms 28 may be any shape including, without limitation, circular, square, hexagonal, octagonal, and/or the like.

The pair of arms 28 may be formed of any material, including, but not limited to, a metal, such as steel, aluminum, copper, and/or the like, a polymer, a composite, a plastic, a resin, and/or the like. In some embodiments, each of the pair of arms 28 extend in the longitudinal direction (i.e., in the +/−Y direction) with a length that is equal to a length of the other one of the pair of arms 28 with respect to the base member 20. In other embodiments, one of the pair of arms 28 may have a length that is less than or greater than a length of the other of the pair of arms 28. Further, each of the pair of arms 28 may have different widths in the lateral direction (i.e., in the +/−X direction), and/or different thicknesses in the vertical direction (i.e., in the +/−Z direction) between the inner and exterior surfaces 37*a*, 37*b*, The pair of engaging members 40 may be coupled to the pair of arms 28. In some embodiments, one of the pair of engaging members 40 may be coupled to the second portion 34 of one of the pair of arms 28 adjacent to or near the second end 35, and the other of the pair of engaging members 40 may be coupled to the second portion 34 of the other of the pair of arms 28, adjacent to or near the second end 35. As such, portions of an outer surface 41 of the pair of engaging members 40 may extend beyond the second end 35 of the pair of arms 28 to ensure that at least one of the pair of engaging members 40 make contact with the guide rail 4, as discussed in greater detail herein. That is, portions of the outer surface 41 of the pair of engaging members 40 form an outer periphery that may extend beyond the second end 35 of the respective arm of the pair of arms 28.

Further, in some embodiments, the second end 35 of the pair of arms 28 may be positioned below the pair of engaging members 40 in the vertical direction (i.e., in the +/−Z direction) such that the pair of engaging members 40 are positioned on, or adjacent to, the exterior surface 37*b* of the pair of arms 28. In other embodiments, the second end 35 of the pair of arms 28 may be positioned above the pair of engaging members 40 in the vertical direction (i.e., in the +/−Z direction) such that the pair of engaging members 40 are positioned on, or adjacent to, the inner surface 37*a* of the pair of arms 28. In each embodiment, the pair of engaging members 40 may be coupled to the second end 35 of the pair of arms 28 in a direction that is perpendicular to the direction of travel of the elevator cab 2. It should be understood that the second end 35 of the pair of arms 28 may be positioned anywhere to couple the pair of engaging members 40 to the second end 35 of the pair of arms 28. Further, it should be understood that the pair of engaging members 40 may be coupled to the second end 35 of the pair of arms 28 in any direction and is not limited to a perpendicular position with respect to the direction of travel of the elevator cab 2. The pair of engaging members 40 may be coupled to the pair of arms 28 via a fastener 39, such as a bolt and nut, rivet, screw, and/or the like, such that, in some embodiments, the pair of engaging members 40 may rotate about the fastener 39, as discussed in greater detail herein.

Still referring to FIGS. 3-7, the pair of engaging members 40 may each be a roller that is rotatably coupled to the second portion 34 of the pair of arms 28. It should be appreciated that the pair of engaging members 40 may include any shape to provide a frictional force against the guide rail 4 when the pair of arms 28 are in the engaged positioned. For example, the pair of engaging members 40 may be friction pads, chevron shaped, L-shaped, and/or the like.

Each of the pair of engaging members 40 may rotate about an axis 42 that extends in parallel with the extension of the guide rail 4. That is, the axis 42 extends in the same travel direction as the guide rail 4. In the illustrated embodiments, the axis 42 may extend in the vertical direction (i.e., in the +/−Z direction). This is non-limiting and the travel direction as the guide rail 4 may be in the longitudinal direction (i.e., in the +/−Y direction), the lateral direction (i.e., in the +/−X direction), and/or in combinations of directions thereof. Further, each one of the pair of engaging members 40 may each rotate about the axis 42 in one direction when moving to engage with the guide rail 4, shown in FIGS. 6-7 and illustrated by arrow A3 and in an opposite direction to disengage with the guide rail 4, shown in FIGS. 4-5 and illustrated by arrow A4, as discussed in greater detail herein.

The pair of engaging members 40 may be formed of any material, such as a polyurethane, steel, aluminum, rubber, polymer, PVC, composite, plastic, resin, and/or the like. The pair of engaging members 40 may be formed of different materials that include different coefficients of friction.

The biasing member 50 may extend between each of the pair of arms 28 to be coupled to each sidewall 29 of the pair of arms 28. The biasing member 50 may pivotally bias the pair of arms 28 in the lateral direction (e.g., in the +/−X direction) to provide a biasing force, illustrated by arrows A5 and A6 in FIGS. 4-7, that biases the pair of arms 28 to the disengaged position. That is, the biasing member 50 may bias the pair of arms 28 to change or modify a set width between the pair of engaging members 40. The biasing member 50 may be a spring, a band, and/or the like. The biasing force of the biasing member 50 may be predetermined based on the type of biasing member 50. Moreover, the biasing force may be adjustable. That is, the spring coefficient of the biasing member 50 may be adjustable to change a desired biasing force for different applications, different pairs of engaging members 40, tension on the biasing member 50, and/or the like. The biasing member 50 may be coupled to each sidewall 29 of the pair of arms 28 via a fastener 55, such as a hanger screw, a nut and bolt, a rivet, a hook and loop fastener, and or the like. In some embodiments, the fastener 55 may be configured to adjust the biasing force of the biasing member 50 by adjusting a tension of the biasing member 50. In other embodiments, the adjustment of the biasing force is completed by manipulation of the biasing member 50 itself.

Still referring to FIGS. 3-7, in some embodiments with the pair of spaced apart guide rails 4, each of the pair of arms 28 may be biased by the biasing member 50 either toward one another, away from one another, and/or in the same direction (e.g., in the +/−X direction). In embodiments where the biasing member 50 biases the pair of arms 28 away from one another, the engaging members 40 may be positioned between the pair of spaced apart guide rails 4, such that when the elevator stabilizing assembly 10 is moved from the disengaged position to the engaged position, the pair of engaging members 40 move toward one another. In other embodiments, the engaging members 40 may be positioned on opposing sides of the pair of spaced apart guide rails 4, such that when the elevator stabilizing assembly 10 is moved from the disengaged position to the engaged position, the pair of engaging members 40 move away from one another in a lateral direction (i.e., +/−X direction). In other embodiments, the pair of arms 28 are biased in the same direction, the biasing member 50 may be a pair of biasing members 50 with each biasing member 50 being coupled to a respective arm 28 to bias the pair of arms 28 in the same direction.

In some embodiments, a lateral actuator (not shown) may replace and/or be used in conjunction with the biasing member 50. The lateral actuator may be coupled to at least one of the pair of arms 28 similarly to the biasing member 50. The lateral actuator may be configured to move the pair of arms 28 between the disengaged position and the engaged position.

The pair of spacers 54 may be coupled to each sidewall 29 of the pair of arms 28 and positioned within each respective notch of the pair of notches 36. As such, each of the pair of spacers 54 may be configured to make contact with the base member 20, at the respective notch of the pair of notches 36, when the pair of arms 28 are in the disengaged position. As such, the pair of spacers 54 restrict the movement of the pair of arms 28 and the engaging members 40 in the lateral direction (i.e., in the −X direction). That is, each of the pair of spacers 54 may set a space or gap between the pair of arms 28 when each of the pair of arms 28 are in the disengaged position. It should be appreciated that, in some embodiments, only one of the pair of spacers 54 may be used to set the space or gap between the pair of arms 28 when the pair of arms 28 are in the disengaged position. Each of the pair of spacers 54 may be adjusted to increase or decrease the space or gap between the pair of arms 28 and the base member 20, thereby changing the space or gap of the pair of arms 28 and the pair of engaging members 40 when the pair of arms 28 are in the disengaged position.

In some embodiments, each of the pair of spacers 54 may be coupled to a bolt threadably coupled to the sidewall 29 of the pair of arms 28. As such, rotation of the bolt may adjust the spacing or gap between the pair of arms 28 and the base member 20 in the disengaged position. An increase in the spacing reduces the amount of force and distance required to move the pair of arms 28 and the pair of engaging members 40 from the disengaged position to the engaged position when the pair of engaging members 40 make contact against the guide rail 4. Further, having an adjustable disengaged position may reduce wear on both the stabilizing device 18 and the guide rail 4. The change in the spacing of the disengaged position changes a spacing S1 (FIG. 5) between the pair of engaging members 40.

In some embodiments, the elevator stabilizing assembly 10 may further include a longitudinal biasing member coupled to the actuator 12, the stabilizing device 18, or both. The longitudinal biasing member may be configured to bias the actuator 12 between the extended position and the retracted position. That is, the longitudinal biasing member may bias the actuator 12 into the retracted position such that the actuator 12 may be returned to the retracted position, spacing the pair of engaging members 40 apart from the guide rail 4, without actuation of the actuator 12. This may be desirable because of a reduction in the amount of energy required to operate the elevator stabilizing assembly 10. It may additionally be desirable in disengaging the elevator stabilizing assembly 10 from the guide rail 4 in circumstances where electricity is disconnected from the elevator stabilizing assembly 10, such as during power outages. The longitudinal biasing member may be coupled to the base member 20 of the stabilizing device 18 via a fastener, such as bolt and nuts, rivets, screws, welding, epoxy, adhesive, and/or the like.

Referring now to FIGS. 4 and 5, the elevator stabilizing assembly 10 is depicted in the unstabilized state. In the unstabilized state, the actuator 12 is in the retracted position, the pair of arms 28 and the pair of engaging members 40 are each in the disengaged position. In the retracted position, each of the pair of engaging members 40 are spaced apart from the guide rail 4 such that each the pair of engaging members 40 are free from contact with the guide rail 4. Further, in the unstabilized state, where the actuator 12 is in the retracted position, the biasing member 50 maintains the spacing or gap between the pair of arms 28, dependent on the positioning of the pair of spacers 54, such that the space S1 between the pair of engaging members 40 is maintained and repeatable. As such, in the disengaged position, the pair of engaging members 40 may be controlled to a set position (e.g., the space S1) between each of the pair of engaging members 40.

That is, in the disengaged position, the pair of arms 28 contact the respective one of the pair of spacers 54 such that the space between the pair of arms 28 is set by the pair of spacers 54. That is, each one of the pair of spacers 54 restricts lateral movement (e.g., in the +/−X direction) of the pair of arms 28 in a direction towards each other, thereby maintaining the space or gap between the pair of arms 28 and between the pair of engaging members 40. However, this is non-limiting, and the spacing between the pair of arms 28 and/or the pair of engaging members 40, in the disengaged position, may be set by the biasing force applied onto the pair of arms 28, by a size and/or shape of the pair of engaging members 40, and/or the like. Further, it should be appreciated that, in the disengaged position, the spacing S1 is less than the width W of the guide rail 4.

Referring now to FIGS. 6 and 7, the elevator stabilizing assembly 10 is depicted in the stabilized state. In the stabilized state, the actuator 12 is in the extended position and each of the pair of engaging members 40 are in the engaged position. Further, in the stabilized state, when the actuator 12 is in the extended position, the pair of engaging members 40 are positioned to contact opposing side surfaces 4*a*, 4*b* of the guide rail 4. That is, in the engaged position, the pair of engaging members 40 are displaced laterally (in the +/−X direction) to change the width or spacing S1 between the pair of engaging members 40. That is, the contact with the guide rail 4 creates a force greater than the biasing force such that the space S1 or width between the pair of engaging members 40 is increased to match a width W of the guide rail 4. As such, in the stabilized state, the pair of engaging members 40 are spaced apart by a spacing S2, which is, in some embodiments, equal to the width W of the guide rail 4. In other embodiments, the pair of engaging members 40 are spaced apart by a spacing S2, which is less than or greater than the width W of the guide rail 4. For example, if the guide rail 4 or other fixed member of the hoistway 7 (FIG. 3) includes a receiving groove, is an I-beam, and/or the like, in the engaged position, the spacing S2, may be less than the width W.

It should be understood that, in the engaged position, the biasing member 50 biases the pair of arms 28 along with the pair of engaging members 40 inward toward each other, or in the lateral direction (i.e., in the +/−X direction) and toward the disengaged position, as illustrated by arrows A5 and A6. Specifically, the biasing member 50 moves one of the pair of arms 28 in the direction of arrow A5, and moves the other of the pair of arms 28 in the direction of arrow A6. The biasing force results in a normal force between the pair of engaging members 40 and the guide rail 4. As such, to move the pair of arms 28 and the pair of engaging members 40 into the engaged position, the lateral force (i.e., in the +/−X direction) acting on the pair of engaging members 40 may be greater than the biasing force applied by the biasing member 50. When the pair of engaging members 40 make contact with opposing side surfaces 4*a*, 4*b* of the guide rail 4, this lateral force causes the pair of arms 28 to move or pivot about the pair of pivot members 30, in the direction illustrated by the arrow A1, thus changing the spacing from S1 to S2 between the pair of engaging members 40, as discussed in greater detail herein.

However, in alternate embodiments not depicted in the drawing figures, with an alternately designed fixed member or guide rail 4, it is contemplated that the biasing member 50 could apply a force to the pair of arms 28 to bias the pair of arms 28 and/or the engaging members 40 either away from each other, or in the same direction. In such embodiments, the biasing member 50 may include more than one biasing member as necessary, for example one biasing member 50 per each arm 28 of the pair of arms 28, or one biasing member per each engaging member 40, and/or the like, without departing from the scope of the present disclosure.

Now referring back to FIGS. 4-7, each of the pair of arms 28 may pivot about the pair of pivot members 30 in the direction of arrow A1 when moving from the disengaged position to the engaged position to position the pair of engaging members 40 at the spacing S2. It should be appreciated that the movement from the disengaged position to the engaged position may be caused when at least one of the pair of engaging members 40 makes contact with at least a portion of the guide rail 4. In other embodiments, the movement from the disengaged position to the engaged position may be caused by an actuator, and/or the like. When pivoting in the direction of arrow A1, the second end 35 of at least one of the pair of arms 28 moves laterally (e.g., in the +/−X direction), thereby extending the biasing member 50 in the lateral direction (e.g., in the +/−X direction).

Each of the pair of arms 28 may pivot about the pair of pivot members 30 in the direction of arrow A2 when moving from the engaged position to the disengaged position. When the actuator 12 moves from the extended position to the retracted position, at least one of the pair of engaging members 40 are free from contact with the guide rail 4. When at least one of the pair of engaging members 40 are free from contact with the guide rail 4, the biasing member 50 moves the second end 35 of the pair of arms 28 laterally (e.g., in the +/−X direction), thereby pivoting the pair of arms 28 about the pair of pivot members 30 in the direction of arrow A2 to position the pair of engaging members 40 at the spacing S1.

Figure 9:
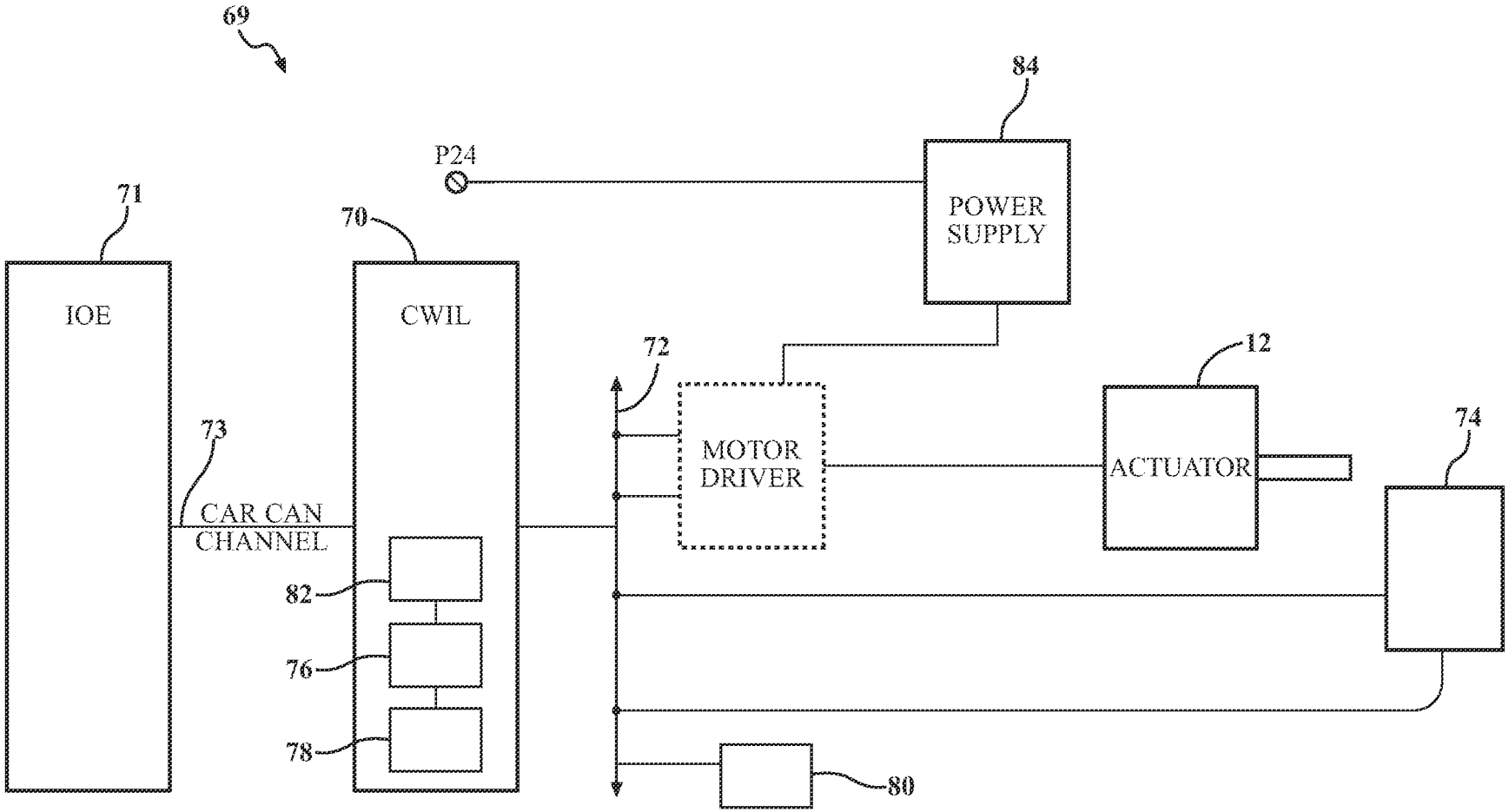
FIG. 9 schematically depicts a control system for operating the elevator stabilizing assembly of FIG. 2, according to one or more embodiments shown and described herein.
Figure 10:
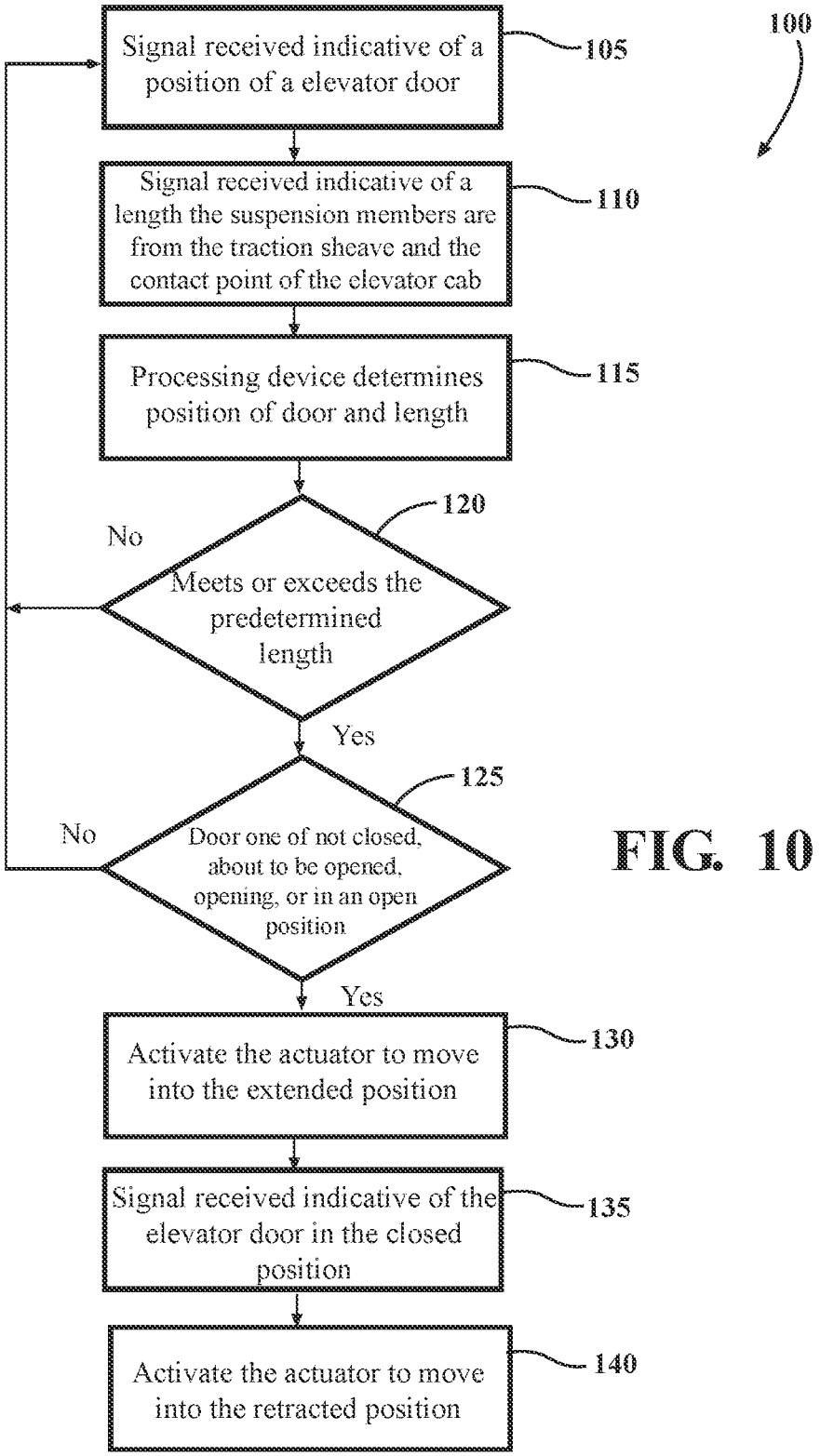
FIG. 10 schematically depicts a flowchart of an illustrative method of operating the elevator stabilizing assembly of FIG. 2, according to one or more embodiments shown and described herein.

Referring now to FIGS. 2, 3 and 9, the elevator stabilizing assembly 10 may further include a central processor architecture 69 configured to perform the functionality as described herein. The central processor architecture 69 includes an internet of everything module 71 communicatively coupled to a processing device 70 via a CAN BUS connection 73. The central processor architecture 69 may further include a communication path 72 that communicatively couples the processing device 70 to the actuator 12 and to other components of the central processor architecture 69 such as a power supply 84. It is noted that the elevator stabilizing assembly 10 may have a greater or fewer number of components communicatively coupled to one another without departing from the scope of the present disclosure.

The communication path 72 provides data interconnectivity between various modules and/or components that form part of the elevator stabilizing assembly 10. Specifically, each of the modules can operate as a node that may send and/or receive data. In some embodiments, the communication path 72 includes a conductive material that permits the transmission of electrical data signals to and between processors, memories, sensors, actuators, and/or the like, throughout the elevator stabilizing assembly 10. In another embodiment, the communication path 72 may be a bus. In further embodiments, the communication path 72 may be wireless and/or an optical waveguide.

The processing device 70 may be configured to selectively operate components of the elevator stabilizing assembly 10 in response to receiving a signal indicative of an elevator door position and a position of the elevator cab 2 within the hoistway 7, as discussed in greater detail herein. The processing device 70 may include one or more non-transitory, processor-readable storage mediums 82 and one or more memory modules 78 communicatively coupled to one or more processors 76 over the communication path 72. The processing device 70 may include any device capable of executing machine-readable instructions, such as processing instructions, stored on the one or more non-transitory, processor-readable storage mediums 82. As such, the processing device 70 may include a controller, an integrated circuit, a microchip, a computer, a central processing unit, and/or any other computing device. It is noted that the processing device 70 may reside within the elevator stabilizing assembly 10 and/or external to the elevator stabilizing assembly 10.

As discussed herein, the one or more memory modules 78 are communicatively coupled to the processing device 70 and the one or more non-transitory, processor-readable storage mediums 82 via the communication path 72. The one or more memory modules 78 may be configured as volatile and/or nonvolatile memory and, as such, may include random access memory (including SRAM, DRAM, and/or other types of RAM), flash memory, secure digital (SD) memory, registers, compact discs (CD), digital versatile discs (DVD), and/or other types of non-transitory computer-readable mediums. Depending on the particular embodiment, the one or more memory modules 78 and/or the one or more non-transitory, processor-readable storage mediums 82 may reside within the elevator stabilizing assembly 10 and/or external to the elevator stabilizing assembly 10. The one or more memory modules 78 may be configured to store one or more pieces of logic to move the elevator stabilizing assembly 10 between the stabilized state and the unstabilized state.

Embodiments include logic stored on the one or more memory modules 78 that includes machine-readable instructions and/or an algorithm written in any programming language of any generation (e.g., 1GL, 2GL, 3GL, 4GL, and/or 5GL) such as machine language that may be directly executed by the processing device 70, assembly language, obstacle-oriented programming (OOP), scripting languages, microcode, and/or the like, that may be compiled or assembled into machine readable instructions and stored on a machine readable medium. Similarly, the logic and/or algorithm may be written in a hardware description language (HDL), such as logic implemented via either a field-programmable gate array (FPGA) configuration or an application-specific integrated circuit (ASIC), and their equivalents. Accordingly, the logic may be implemented in any conventional computer programming language, as pre-programmed hardware elements, and/or as a combination of hardware and software components. As will be described in greater detail herein, logic stored on the one or more memory modules 78 allows the processing device 70 to, for example, determine when a position of the door 2*a* of the elevator cab 2 is in a closed position, or alternatively, determine when the door 2*a* of the elevator cab 2 is about to be opened, not in a closed position, opening, or already in an open position. Further, logic stored on the one or more memory modules 78 allows the processing device 70 to, for example, determine the distance the contact point (e.g., the pair of idler sheaves 5*b*) of the elevator cab 2 is from the traction sheave 5*a* (i.e. the length of suspension members 3 under tension between the traction sheave 5*a* and the elevator cab 2), and, in response, either maintain or actuate the actuator 12 to move into the retracted position and the pair of spaced apart arms 28 into the disengaged position. As a second example, the logic stored on the one or more memory modules 78 allows the processing device 70 to determine a length of the suspension members 3 under tension between the traction sheave 5*a* and the contact point of the elevator cab 2 based on knowing the position of the elevator cab 2 within the hoistway 7, based on sensing technologies that senses the length of each of the plurality of suspension members 3, by sensing a flag or another marker indicating when, or that the length of the plurality of suspension members 3 exceeds a predetermined length, and/or the like.

As such, based on predetermined parameters, such as a position of the door 2*a* of the elevator cab 2 and whether it is about to be opened, is not in a closed position, is opening, or is already in an open position, and whether the length of suspension members 3 under tension between the traction sheave 5*a* and the contact point of the elevator cab 2 exceeds a predetermined length, the processing device 70 actuates the actuator 12 to move into the extended position and the pair of spaced apart arms 28 into the engaged position.

That is, the processing device 70 may control the actuator 12 for selectively moving the elevator stabilizing assembly 10 between the stabilized state and the unstabilized state. In some embodiments, the processing device 70 may be configured to move the actuator 12 into the extended position in response to receiving a signal indicating that a position of the door 2*a* of the elevator cab 2 is in the open position and the length of the plurality of suspension members 3 exceeds a predetermined length As used herein, "predetermined length" is a length of each of the plurality of suspension members 3 where the elevator cab 2 may oscillate, or bounce, in response to passengers and/or cargo being loaded onto the elevator cab 2. For example, the predetermined length may be equal to and/or greater than 250 feet. However, the predetermined length may be 50 feet, 100 feet, 150 feet, 200 feet, 300 feet, 350 feet, 400 feet, or the like. As such, the elevator stabilizing assembly 10 may activate only when necessary to prevent oscillation of the elevator cab 2, thereby reducing the frequency of use and prolonging the life of the elevator stabilizing assembly 10.

In other embodiments, the processing device 70 may be configured to move the actuator 12 into the extended position in response to receiving a signal indicating that a position of the door 2*a* of the elevator cab 2 is in the open position and the elevator cab 2 is at a predetermined floor. The predetermined floor may be a set of floors, where when the elevator cab 2 is positioned at each such floor, the length of the plurality of suspension members 3 between the elevator cab 2 and the traction sheave 5*a* is greater than or equal to the predetermined length.

It should be appreciated that the processing device 70 may additionally be configured to move or maintain the actuator 12 into the retracted position in response to receiving a signal indicating that a position of the door 2*a* of the elevator cab 2 is in the closed position and/or the length of the plurality of suspension members 3 does not exceed the predetermined length from the traction sheave 5*a*, as discussed in greater detail herein.

In other embodiments, the processing device 70 may be configured to move the actuator 12 into the extended position in response to receiving a signal indicating not only that a position of the door 2*a* of the elevator cab 2 is in the fully open position, but alternatively that the door 2*a* is one of in a closed position but about to be opened, is not in a closed position, or is still opening. The signal indicating that the position of the door 2*a* is about to be opened may be received by the processing device 70 when the elevator cab 2 is approaching the landing, or stops at the landing and is waiting for the door 2*a* to be opened due to a delay in the mechanical operation of a door opening mechanism when the elevator cab 2 reaches the landing. The signal indicating that the position of the door 2*a* is not in the closed position may be received when the door 2*a* is in a plurality of positions that are not the closed position. That is, the door opening may be between a plurality of positions between when the door 2*a* is actually fully opened and actually fully closed. The processing device 70 is configured to recognize these positions, whether based on sensors, mechanical devices, such as linkage, belts, and the like, and operates or actuates the actuator 12 into the extended position from the retracted position in response to the position of the door 2*a* and the predetermined length, as discussed in greater detail herein.

The elevator assembly 1 may include a sensor 74 in electrical communication with the processing device 70. The sensor 74 may be configured to sense the position of the door 2*a* of the elevator cab 2 and send signals to the processing device 70. The sensor 74 may be a proximity sensor, a toggle switch, a limit switch, a laser switch, and/or the like. The processing device 70 may receive the signals from the sensor 74 and determine the position of the door 2*a*.

Still referring to FIGS. 2, 3 and 9, in some embodiments, the elevator assembly 1 may include a sensor 80 in electrical communication with the processing device 70. The sensor 80 may be configured to sense the length that each of the plurality of suspension members 3 between the traction sheave 5*a* and the contact point with the elevator cab 2 and send signals to the processing device 70. The sensor 80 may be a proximity sensor, a toggle switch, a limit switch, a laser switch, and/or the like. The processing device 70 may receive the signals and determine the current length of the plurality of suspension members 3. In embodiments where the traction sheave 5*a* is positioned at the top of the hoistway 7, the elevator stabilizing assembly 10 may activate at the lower levels, or landings, of the building where the length of the suspension members 3 between the traction sheave and the elevator cab 2 is greater than the predetermined length (e.g., the suspension members 3 are under tension and are of a sufficient length between the traction sheave 5*a* and the elevator cab 2 such that an oscillation or bounce due the tension and length is likely). In other embodiments, the length may be calculated by a floor or landing number and thus a sensor is not needed. That is, the processing device 70 may be programmed to activate the elevator stabilizing assembly 10 when the elevator cab 2 is at or below a landing number, or floor. Alternatively, for embodiments in which the traction sheave 5*a* is positioned at the bottom of the hoistway 7 (FIG. 1B), the processing device 70 may also be programmed to activate the elevator stabilizing assembly 10 when the elevator cab 2 is at or below a landing number, or floor.

Referring now to FIGS. 2-10, an illustrative method 100 for operating the elevator stabilizing assembly 10 is depicted. Although the steps associated with the blocks of FIG. 10 will be described as being separate tasks, in other embodiments, the blocks may be combined or omitted. Further, while the steps associated with the blocks of FIG. 10 will described as being performed in a particular order, in other embodiments, the steps may be performed in a different order. Additionally, the method 100 may include more or less steps than described without departing from the present disclosure.

At block 105, the method 100 may include receiving a signal from the elevator assembly 1, such as from the sensor 74, the sensor 80, and the like, indicative of a position of the elevator door 2*a*. For example, the signal may be indicative of whether the door 2*a* of the elevator cab 2 is one of not closed, about to be opened, opening, or in an open position. The signal indicating that the position of the door 2*a* is about to be opened may be received when the elevator cab 2 is approaching the landing, or stops at the landing and is waiting for the door 2*a* to be opened due to a delay in the mechanical operation of a door opening mechanism when the elevator cab 2 reaches the landing. As such, the signal indicating that the position of the door 2*a* is not in a closed position may be received when the door 2*a* is in a plurality of positions that are not the closed position.

At block 110, the method 100 may alternatively, or additionally, include receiving a signal from the sensor 74, the sensor 80, and the like, indicative of the length of the suspension members 3 between the traction sheave 5*a* and the elevator cab 2. In other embodiments, the length of the suspension members 3 between the traction sheave 5*a* and contact point with the elevator cab 2, and/or whether such length is equal to or greater than the predetermined length, may be determined based on the current floor or landing location at which the elevator cab 2 is currently positioned, and/or any one or more of the position of the traction sheave 5*a* within the hoistway 7, or the total length of the suspension members 3 in the elevator system.

At block 115, the processing device 70 determines the position of the door and the length of the suspension members 3 between the traction sheave 5*a* and the contact point with the elevator cab 2. At block 120, the processing device 70 determines whether the length of the suspension members 3 between the traction sheave 5*a* and the elevator cab 2 meets or exceeds the predetermined length and, at block 125 the processing device 70 determines whether the door 2*a* is one of not closed, about to be opened, opening, or in an open position. If the predetermined length is not met, at block 120, and/or the door 2*a* is not in one of one of not closed, about to be opened, opening, or in the open position, then the processing device 70 may prevent actuation of the actuator 12, thereby maintaining the elevator stabilizing assembly 10 in the disengaged position. It should be appreciated that if the length of the suspension members 3 between the traction sheave 5*a* and the elevator cab 2 is not equal to or greater than the predetermined length, even though the elevator door 2*a* is in the open, about to open, or opening positions, the processing device 70 may prevent actuation of the actuator 12, thereby maintaining the elevator stabilizing assembly 10 in the disengaged position. Further, it should be understood that the method 100 may wait and loop between blocks 105 and 125 until a determination is made in blocks 120 and 125 that the length of the suspension members 3 between the traction sheave 5*a* and the elevator cab 2 is not equal to or greater than the predetermined length and that the door 2*a* is one of not closed, about to be opened, opening, or in an open position.

At block 130, the processing device 70 activates the actuator 12 to move the actuator 12 from the retracted position to the extended position. The actuator 12 may move the actuating member 13, thereby moving the support member 27 in the longitudinal direction (i.e., in the +Y direction) toward the guide rail 4. The movement of the support member 27 additionally moves the stabilizing device 18 toward the guide rail 4. As such the pair of spaced apart arms 28 are moved from the disengaged position to the engaged position. When the actuator 12 is in the extended position, the pair of engaging members 40 contact portions the guide rail 4, with the guide rail 4 being positioned between the pair of engaging members 40, thereby displacing the pair of engaging members 40 from the first spacing S1 to the second spacing S2. In embodiments where the elevator assembly 1 includes a pair of guide rails 4, the pair of engaging members 40 contact portions of the corresponding guide rail 4, thereby displacing the pair of engaging members 40 from the first spacing S1 to the second spacing S2, where the second spacing S2 may be less than the first spacing S1. In embodiments where the pair of arms 28 are biased in the same direction, the pair of engaging members 40 may be displaced upon contact with the guide rail 4 in the same direction such that the first spacing S1 and the second spacing S2 are equal.

In the engaged position, the biasing member 50 applies a biasing force that biases the pair of engaging members 40 towards, against, or into the outer side faces of the guide rail 4 in the lateral direction (i.e., in the +/−X direction). When in the engaged position, passengers and/or cargo may enter the elevator cab 2. The engagement between the pair of engaging members 40 and the guide rail 4 causes a frictional force to be applied to the elevator cab 2 in a direction opposite the travel of the elevator cab 2 along the guide rail 4 to prevent undesirable oscillation or bouncing movement of the elevator cab 2 caused by the weight of passengers and/or cargo entering/exiting the elevator cab 2. That is, the frictional force reduces the amount, or amplitude, of oscillation in the suspension members 3, such as hoisting belts, caused by passengers and/or cargo entering/exiting the elevator cab 2.

At block 135, the method 100 may include receiving a signal indicative of the door 2*a* of the elevator cab 2 being in a closed position. At block 140, the processing device 70 may maintain the actuator 12 in the retracted position and/or move the actuator 12 from the extended position to the retracted position by moving the actuating member 13, thereby moving the support member 27 in the longitudinal direction (i.e., in the −Y direction) away from the guide rail 4. The movement of the support member 27 additionally moves the stabilizing device 18 away from the guide rail 4 in the longitudinal direction (i.e., in the −Y direction). As such, the pair of spaced apart arms 28 are moved from the engaged position to the disengaged position.

When the actuator 12 is in the retracted position, the pair of engaging members 40 may be spaced apart from the guide rail 4 in the longitudinal direction because the biasing member 50 biases the pair of arms 28 inward, toward each other, thereby moving the pair of engaging members 40 to change the space or gap between the pair of engaging members 40 from the space S2 into the space S1. Once the elevator stabilizing assembly 10 is in the unstabilized state, the elevator cab 2 may move.

It should now be understood that described above is an elevator stabilizing assembly for damping, braking movement of an elevator cab, and/or dissipating energy. The elevator stabilizing assembly includes a stabilizing device and an actuator coupled to the stabilizing device. The stabilizing device includes a pair of spaced apart arms, a pair of engaging members coupled to the pair of arms, and a biasing member positioned between the pair of arms biasing the pair of arms between a disengaged position and an engaged position. The actuator is configured to move the stabilizing device into contact with a fixed member of a hoistway, such as a guide rail. When in contact with the guide rail, the biasing member applies a biasing force to the pair of engaging members, biasing the pair of engaging members into the guide rail. The biasing force increases a frictional force between the engaging members and the guide rail, where the frictional force reduces oscillation of the elevator cab.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. An elevator stabilizing assembly for dissipating energy of an elevator assembly, the elevator assembly having an elevator cab, a plurality of suspension members, and a fixed member of a hoistway, the plurality of suspension members move the elevator cab between a plurality of positions and the fixed member guides the elevator cab within the hoistway between the plurality of positions, the elevator stabilizing assembly comprising:

an actuator configured to move between a retracted position and an extended position; and a stabilizing device having:

an arm having a sidewall;

a spacer coupled to the sidewall of the arm; and a biasing member coupled to the arm and configured to bias the arm, wherein, when the actuator is moved into the extended position, the biasing member causes the arm to be biased in a direction against the fixed member such that at least a portion of the arm is in contact with the fixed member of the elevator assembly, and when the actuator is moved from the extended position to the retracted position, the arm is moved such that the at least the portion of the arm is free from contact with the fixed member of the elevator assembly and is held in a predetermined position by the biasing member and the spacer.

2. The elevator stabilizing assembly of claim 1, further comprising:

at least one engaging member coupled to the arm, wherein the at least one engaging member contacts the fixed member when the actuator is moved into the extended position.

3. The elevator stabilizing assembly of claim 1, further comprising:

a base member coupled to the actuator; and the arm is pivotally coupled to the base member, wherein when the actuator is moved between the extended position and the retracted position, the base member moves the arm in a longitudinal direction.

4. The elevator stabilizing assembly of claim 3, further comprising:

a processing device, and a storage medium in communication with the processing device, wherein the storage medium comprising one or more programming instructions that, when executed, cause the processing device to:

determine when a door of the elevator cab is one of about to be opened, or not in a closed position, and actuate the actuator to move the actuator into the extended position and the at least a portion of the arm is in contact with the fixed member.

5. The elevator stabilizing assembly of claim 4, wherein the one or more programming instructions that, when executed, cause the processing device to:

determine when the door of the elevator cab is in the closed position or determine when a length of the plurality of suspension members is less than a predetermined length, and actuate the actuator to move the actuator into the retracted position and the arm free from contact with the fixed member.

6. An elevator stabilizing assembly for damping movement of an elevator cab of an elevator assembly, the elevator assembly having the elevator cab, a plurality of suspension members from which the elevator cab is suspended, and a fixed member of a hoistway, the plurality of suspension members move the elevator cab between a plurality of positions and the fixed member guides the elevator cab within the hoistway between the plurality of positions, the elevator stabilizing assembly comprising:

an actuator configured to move between a retracted position and an extended position; and a stabilizing device having:

a pair of arms pivotally biased by a biasing member positioned between the pair of arms and to maintain a predetermined spacing between the pair of arms; and a pair of engaging members, one of the pair of engaging members coupled to one of the pair of arms and the other one of the pair of engaging members coupled to the other one of the pair of arms, wherein, the elevator stabilizing assembly is configured to move between an unstabilized state where the actuator is in the retracted position such that the pair of engaging members are held in a position spaced apart from one another by the biasing member, and a stabilized state where the actuator is in the extended position and where the biasing member causes each of the pair of arms to be biased in a direction against the fixed member such that at least a portion of the pair of engaging members is in contact with the fixed member of the elevator assembly.

7. The elevator stabilizing assembly of claim 6, wherein in the unstabilized state, the pair of arms are moved such that the pair of engaging members are free from contact with the fixed member of the elevator assembly.

8. The elevator stabilizing assembly of claim 7, wherein the pair of engaging members are biased with a biasing force in a lateral direction from the biasing member to set the spacing between the pair of engaging members such that the pair of engaging members make contact the fixed member of the elevator assembly when the actuator is in the extended position.

9. The elevator stabilizing assembly of claim 6, further comprising:

a processing device; and a storage medium in communication with the processing device, wherein the storage medium includes one or more programming instructions that, when executed, cause the processing device to:

determine when a door of the elevator cab is in an open position, and actuate the actuator to move the actuator into the extended position and each of the pair of arms biased in the direction against the fixed member.

10. The elevator stabilizing assembly of claim 9, wherein the one or more programming instructions that, when executed, cause the processing device to:

determine when the door of the elevator cab is in a closed position, and actuate the actuator to move the actuator into the retracted position and the pair of arms into the disengaged position.

11. The elevator stabilizing assembly of claim 6, wherein the stabilizing device further comprises:

a base member coupled to the actuator; and each of the pair of arms are pivotally coupled to the base member, wherein when the actuator is moved between the extended position and the retracted position, the base member moves each of the pair of arms.

12. The elevator stabilizing assembly of claim 11, wherein:

the base member includes a pair of elongated slots, and each of the pair of arms includes a first portion and a second portion spaced apart from the first portion, the first portion being positioned within one of the pair of elongated slots, one of the pair of engaging members being coupled to the second portion of one of the pair of arms, and the other of the pair of engaging members being coupled to the second portion of the other of the pair of arms.

13. The elevator stabilizing assembly of claim 6, further comprising:

a mounting member coupled to the elevator cab and to the stabilizing device, the mounting member including a notch configured to accommodate a geometry of the fixed member of the elevator assembly.

14. The elevator stabilizing assembly of claim 6, wherein each of the pair of engaging members are rollers.

15. The elevator stabilizing assembly of claim 6, wherein each of the pair of arms further comprise:

an exterior surface; and a sidewall extending from the exterior surface, wherein the biasing member is coupled to each sidewall of the pair of arms.

16. The elevator stabilizing assembly of claim 6, wherein each of the pair of arms of the stabilizing device further comprises:

a sidewall;

a spacer coupled to the sidewall and positioned to extend between the pair of arms, the spacer and the biasing member configured to restrict a distance between the pair of arms and the pair of engaging members from contacting each other when the actuator is in the retracted position.

17. The elevator stabilizing assembly of claim 6, wherein the biasing member biases the pair of engaging members such that the space between the pair of engaging members when in the unstabilized state is less than a width of the contact portion of the rail.

* * * * *